US009173795B2

(12) United States Patent
Heidlage et al.

(10) Patent No.: US 9,173,795 B2
(45) Date of Patent: Nov. 3, 2015

(54) BRAKE PEDAL MECHANISM FOR HOSPITAL BED

(75) Inventors: John K. Heidlage, Hamilton, OH (US); David W. Hornbach, Brookville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 940 days.

(21) Appl. No.: 13/368,467

(22) Filed: Feb. 8, 2012

(65) Prior Publication Data

US 2012/0199423 A1 Aug. 9, 2012

Related U.S. Application Data

(60) Provisional application No. 61/440,749, filed on Feb. 8, 2011.

(51) Int. Cl.
*A61G 7/05* (2006.01)

(52) U.S. Cl.
CPC ..... *A61G 7/05* (2013.01); *A61G 2007/0528* (2013.01)

(58) Field of Classification Search
USPC ..... 5/600–618, 86.1; 188/1.12
See application file for complete search history.

(56) References Cited

U.S. PATENT DOCUMENTS

| | | | | |
|---|---|---|---|---|
| 4,439,879 | A * | 4/1984 | Werner | 5/600 |
| 5,377,372 | A * | 1/1995 | Rudolf et al. | 5/600 |
| 6,321,878 | B1 * | 11/2001 | Mobley et al. | 188/1.12 |
| 6,421,854 | B1 * | 7/2002 | Heimbrock | 5/610 |
| 6,460,205 | B1 | 10/2002 | Lewandowski et al. | |
| 7,810,822 | B2 * | 10/2010 | Figel et al. | 280/47.38 |
| 8,452,508 | B2 * | 5/2013 | Frolik et al. | 701/70 |
| 8,528,704 | B2 * | 9/2013 | Hayes et al. | 188/1.12 |
| 8,640,832 | B2 * | 2/2014 | Chen et al. | 188/1.12 |
| 8,781,677 | B2 * | 7/2014 | Roberts et al. | 701/36 |
| 2007/0271700 | A1 * | 11/2007 | Reinke et al. | 5/600 |
| 2008/0047065 | A1 * | 2/2008 | He | 5/600 |
| 2008/0120810 | A1 * | 5/2008 | Reckelhoff et al. | 16/35 R |
| 2013/0111664 | A1 * | 5/2013 | Childs et al. | 5/600 |

FOREIGN PATENT DOCUMENTS

| | | |
|---|---|---|
| DE | 4319516 | 12/1994 |
| EP | 2095803 | 9/2009 |
| JP | 5077604 | 3/1993 |

OTHER PUBLICATIONS

European Search Report for European Patent Application No. 1215442, Sep. 13, 2013.

* cited by examiner

*Primary Examiner* — Michael Trettel
(74) *Attorney, Agent, or Firm* — Barnes & Thornburg LLP

(57) ABSTRACT

A brake system for a patient support apparatus having a base frame includes pedals positioned to be moved by a user to move a brake and a mechanism positioned to coordinate movement of the pedals so that downward movement of one pedal positioned adjacent the head end of the base causes movement of the mechanism in a first direction and downward movement of another of the pedals causes movement of the mechanism in a second direction, opposite the first direction.

34 Claims, 17 Drawing Sheets

BRAKE PEDAL MECHANISM FOR HOSPITAL BED

CROSS-REFERENCE TO RELATED APPLICATIONS

This application claims the priority benefit of an earlier filing date of U.S. Provisional Application Ser. No. 61/440,749, filed Feb. 8, 2011 which is hereby incorporated by reference herein.

BACKGROUND

This disclosure relates to a patient support apparatus having a manual brake for braking one or more of the wheels of the patient support apparatus. More disclosure relates patient support apparatuses having four wheels or casters attached to the base frame for rolling the apparatus from location to location and a braking mechanism for activating brakes on all four wheels simultaneously.

Patient support apparatuses such as hospital beds are moved from location to location. Casters which support the hospital bed allow the bed to be rolled and steered between locations. During movement it is desirable to have free rolling wheels but upon reaching the desired location, brakes are usually applied to the wheels to maintain the bed at the desired location.

It is well known to provide hospital beds with brake/steer casters which include mechanisms for blocking the rotation of the caster wheel or wheels, i.e. braking mechanisms, and mechanisms for blocking swiveling movement of the caster wheel fork, i.e. anti-swivel or directional lock mechanisms. Some beds with four castered wheels include pedals located on opposite sides of the bed which control the braking and anti-swivel mechanisms in each caster. An example of such a bed is shown in Rudolf et al., U.S. Pat. No. 5,377,372 which is expressly incorporated by reference herein. The pedals in Rudolf et al. may not be readily accessible by a caregiver who is currently pushing the bed. Another approach is shown in Mobley et al., U.S. Pat. No. 6,321,878 which is expressly incorporated by reference herein. The pedals adjacent the head end of base in Mobley et al. both provide the same actuation in the same direction. In other words, if one can only achieve a single function by stepping on the pedal(s). To reverse the function from the head end, the pedal(s) must be lifted.

Other hospital beds equipped with such brake/steer casters include four separate brake and/or steer pedals each associated with only one of the four casters with each brake pedal only engaging the brake on the caster with which it is associated and each steer pedal only actuating the anti-swivel mechanism on the caster with which it is associated. One such hospital beds having four casters with four unconnected brake mechanisms, prior to movement of the bed the caregiver must disengage all four brakes by operating all four pedals and after movement of the bed engage all four brakes by again operating all four pedals.

SUMMARY

The present application discloses one or more of the features recited in the appended claims and/or the following features which alone or in any combination, may comprise patentable subject matter.

According to a first aspect of the present disclosure, a brake system for a patient support apparatus having a base frame may include a plurality of wheels supporting the base frame on surface of a floor. The system may include a brake moveable between a first position in which the brake inhibits rotation of one of the plurality of wheels and a second position in which the brake permits the one of the plurality of wheels to rotate freely. The system may also include a plurality of pedals positioned to be moved by a user to move the brake, at least a first one of the plurality of pedals positioned adjacent a head end of the base. The system may still also include a mechanism positioned to coordinate movement of the plurality of pedals so that movement of any one of the plurality of pedals causes movement of the brake, wherein downward movement of the at least one pedal positioned adjacent the head end of the base causes the brake to move from the second position to the first position.

The plurality of pedals may include a second one of the plurality of pedals positioned adjacent the head end of the base, wherein downward movement of the second one of the plurality of pedals causes the brake to move from the first position to the second position.

Downward movement of the second one of the plurality of pedals positioned adjacent the head end may cause the first one of the plurality of pedals positioned adjacent the head end to move upwardly.

The mechanism may be supported for movement relative to a frame of the patient support apparatus.

The patient support apparatus may include a pedal assembly positioned on a lateral side of the patient support apparatus, the pedal assembly operable to move the mechanism.

The brake system may include a plurality of casters and the wheels are part of the casters.

The casters may have multiple modes. The mechanism may be movable to change the mode of the casters. A caster may include a neutral mode where the caster wheel is free to rotate and the caster stem is free to rotate. A caster may include a brake mode wherein the caster wheel is secured against rotation and the caster stem is secured against rotation. A caster may include a steer mode wherein the caster stem is secured against rotation.

The plurality of pedals positioned adjacent the head end of the base each may have a fulcrum axis that corresponds to a fulcrum of the pedal, the fulcrum axes of each of the plurality of pedals being generally collinear.

At least one of plurality of pedals positioned adjacent the head end of the base may be coupled to the mechanism at a position above the fulcrum axes.

At least one of plurality of pedals positioned adjacent the head end of the base may be coupled to the mechanism at a position below the fulcrum axes.

At least two of plurality of pedals may be positioned adjacent the head end of the base, the at least two pedals having generally collinear fulcrum axes with one of the at least two pedals coupled to the mechanism at a position below the fulcrum axes and another of the at least two pedals coupled to the mechanism at a position above the fulcrum axes.

According to another aspect of the present disclosure, a patient support apparatus comprises a lower frame including a plurality of casters and a mode changing mechanism operable to simultaneously modify the mode of at least two casters. Each caster includes at least two operating modes. The mode changing mechanism includes a first actuation mechanism. The first actuation mechanism has a first actuator, a first control arm pivotably coupled to the first actuator, and a first follower pivotably coupled to the first control arm. The first follower is engaged with a first mode key to transfer motion from the first actuator to the first mode key to rotate the first mode key about a first axis. The mode changing mechanism also includes a first transfer arm pivotably coupled to the actuator and positioned between the at least two casters such that movement of the first actuator causes rotation of the first mode key and movement of the first transfer arm.

The actuator includes a force receiving area. The actuator and the transfer arm may be pivotably coupled at a second axis. The first control arm may be pivotably coupled to the actuator at a third axis. The third axis may be positioned between the force receiving area and the second axis.

The first control arm and the first follower may be pivotably coupled at a fourth axis. The fourth axis may be offset from the first axis.

The first mode key may be engaged with a first caster such that at least a portion of the mode changing mechanism is supported from a first caster.

In some embodiments, the patient support apparatus may further comprise a second follower engaged and a second mode key. Movement of the transfer arm may cause movement of the second mode key.

The second mode key may be engaged with a second caster such that the mode changing mechanism is dependently supported from the first and second casters.

The fourth axis may be positioned closer to the first axis than to the second axis.

In some embodiments, the fourth axis may be positioned closer to the second axis than to the first axis.

The distance between the first axis and the second axis may vary when the first mode key is rotated.

In some embodiments, the distance between the third axis and fourth axis may remain fixed when the first mode key is rotated.

In some embodiments, the distance between the first axis and the third axis remains fixed when the first mode key is rotated.

A force applied to the force receiving area of the actuator may cause rotation of the first mode key.

In some embodiments, the follower extends generally vertically upwardly from the first mode key.

In other embodiments, the follower extends generally vertically downwardly from the first mode key.

The mode changing mechanism may further comprise a second actuation mechanism, the second actuation mechanism having a second actuator, a second control arm pivotably coupled to the second actuator, a second follower pivotably coupled to the second control arm, the second follower engaged with a second mode key to transfer motion from the second actuator to the second mode key to rotate the second mode key about a second axis.

In some embodiments, the second actuator may be pivotably coupled to the first transfer arm. The pivotable coupling of the second control arm and the second follower may be vertically higher than the second axis while the pivotable coupling of the first control arm and the first follower may be vertically higher than the first axis.

In some embodiments, the pivotable coupling of the second control arm and the second follower may be vertically lower than the second axis while the pivotable coupling of the first control arm and the first follower may be vertically higher than the first axis.

In some embodiments, the first actuator and the second actuator move in the same vertical direction when the mode changing mechanism is moved between positions. In other embodiments, the first actuator and the second actuator move in opposite vertical directions when the mode changing mechanism is moved between positions.

In some embodiments, the first follower and the second follower may be connected by a transfer bar so that rotation of the first follower may be transferred to the second follower.

In some embodiments, the second actuator may be pivotably coupled to a second transfer arm so that movement of either the first or second actuators may be transferred to both the first and second mode change keys and to both the first and second transfer arms.

In some embodiments, the mode changing mechanism further includes a second actuation mechanism having a second follower, the second follower pivotable about a second axis and pivotably coupled to the first transfer arm at a third axis such that rotation of the follower about the second axis causes movement of the first transfer arm. The second follower may be coupled to a second mode key, the second mode key pivotable about the second axis.

In some embodiments, the second mode key may be engaged with one of the plurality of casters to change the mode of the caster with which the second mode key may be engaged.

In other embodiments, the second mode key may be coupled to an input assembly, the input assembly including a second actuator operable to rotate the second mode key.

The input assembly may comprise a pair of pedals coupled to a parallelogram linkage, the pedals maintaining a horizontal orientation during movement of the pedals between a first position and a second position.

According to another aspect of the present disclosure, a patient support apparatus comprises a frame, a motion transfer mechanism, and an input assembly. The input assembly provides rotational input to the motion transfer mechanism. The input assembly includes a first input actuator for receiving an input force and a pair of links pivotably coupled to the input actuator at first and second axes. The first and second axes are positioned to lie on a first generally vertical line. The first of the links is pivotably coupled to the frame at a third axis. The second of the links is coupled to the motion transfer mechanism at a fourth axis. The third and fourth axes are collinear to a second generally vertical line that is parallel to the first generally vertical line. A force applied to the first input actuator results in torque applied to the motion transfer mechanism at the fourth axis.

In some embodiments, the third and fourth axes may remain stationary when a force is applied to the first input actuator.

In some embodiments, the first input actuator may include a pedal pad. The pedal pad may have a surface maintaining a substantially horizontal orientation during movement of the pedal pad when force is applied to the first input actuator.

The input assembly may include a second input actuator coupled to the first and second links at fifth and sixth axes respectively. The fifth and sixth axes may be positioned on a third generally vertical line. The third generally vertical line may be parallel to the first generally vertical line.

In some embodiments, a force applied to the first input actuator may cause the first input actuator to be lowered and the second input actuator to be raised.

In some embodiments, a vertically downward force applied to the second input actuator may result in torque applied to the motion transfer mechanism at the fourth axis. The torque applied may be in a direction opposite the torque applied when a vertically downward force is applied to the first input actuator.

In some embodiments, the second input actuator includes a pedal pad, the pedal pad having a surface maintaining a substantially horizontal orientation during movement of the pedal pad when force is applied to the second input actuator.

According to yet another aspect of the present disclosure, a brake system for a patient support apparatus having a base comprises a plurality of casters supporting the base on surface of a floor the casters having a plurality of modes, a caster mode changing mechanism moveable between a plurality of positions, and a plurality of pedals positioned to be moved by a user to move the caster mode mechanism between the plurality of positions, at least a first one of the plurality of pedals positioned adjacent a head end of the base. The caster mode changing mechanism coordinates movement of the plurality of pedals so that movement of any one of the plurality of pedals causes movement of the caster mode changing mechanism. Movement of the caster mode changing mechanism will thereby rotate a mode change key to change the mode of at least one caster. Downward movement of the at least one pedal positioned adjacent the head end of the base causes the caster mode key to move from a first position to a second position.

In some embodiments, the plurality of pedals includes a second one of the plurality of pedals positioned adjacent the head end of the base. Downward movement of the second one of the plurality of pedals causes the caster mode changing mechanism to move from the second position to the first position.

In some embodiments, downward movement of the second one of the plurality of pedals positioned adjacent the head end causes the first one of the plurality of pedals positioned adjacent the head end to move upwardly.

In some embodiments, the caster mode changing mechanism is supported for movement relative to a frame of the base of the patient support apparatus.

In some embodiments, the patient support apparatus further includes an input assembly positioned on a lateral side of the patient support apparatus, the input assembly operable to move the caster mode changing mechanism. In some embodiments, the input assembly comprises a pair of pedals coupled to a parallelogram linkage, the pedals maintaining a horizontal orientation during movement of the pedals between a first position and a second position.

In some embodiments, the plurality of pedals positioned adjacent the head end of the base each have a fulcrum axis that corresponds to a fulcrum of the pedal, the fulcrum axes of each of the plurality of pedals being generally collinear. In some embodiments, at least one of plurality of pedals positioned adjacent the head end of the base is coupled to the mechanism at a position above the fulcrum axes. In some embodiments, at least one of plurality of pedals positioned adjacent the head end of the base is coupled to the mechanism at a position below the fulcrum axes.

In some embodiments, at least two of plurality of pedals are positioned adjacent the head end of the base, the at least two pedals having generally collinear fulcrum axes with one of the at least two pedals coupled to the mechanism at a position below the fulcrum axes and another of the at least two pedals coupled to the mechanism at a position above the fulcrum axes.

Additional features and advantages of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
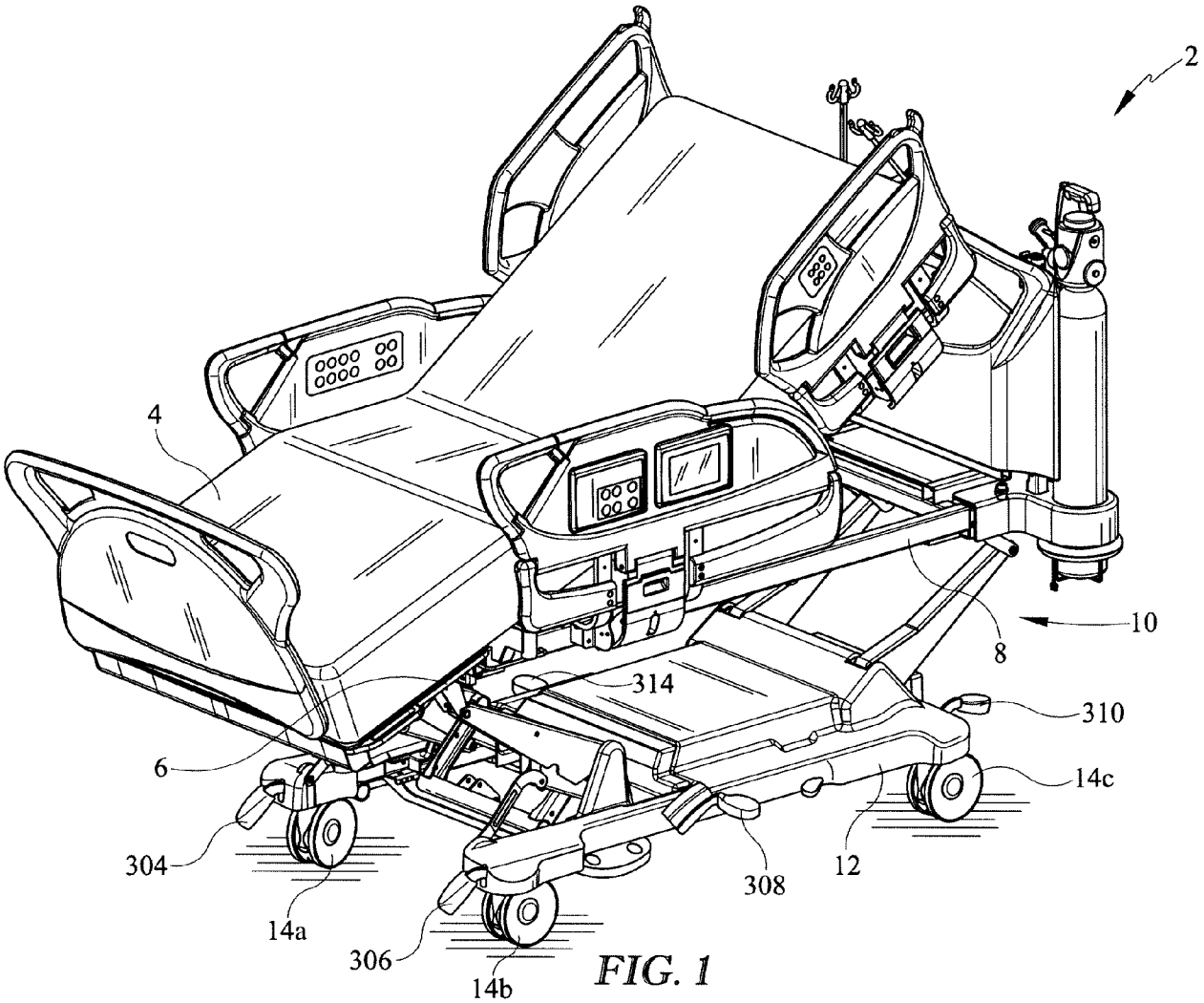
FIG. 1 is a perspective view of a patient support apparatus with portions omitted, the patient support apparatus including a base including a frame and a mechanism for changing the operating mode of the casters supporting the base, the mechanism including a plurality of pedals operable to move the mechanism when depressed by a user.
Figure 2:
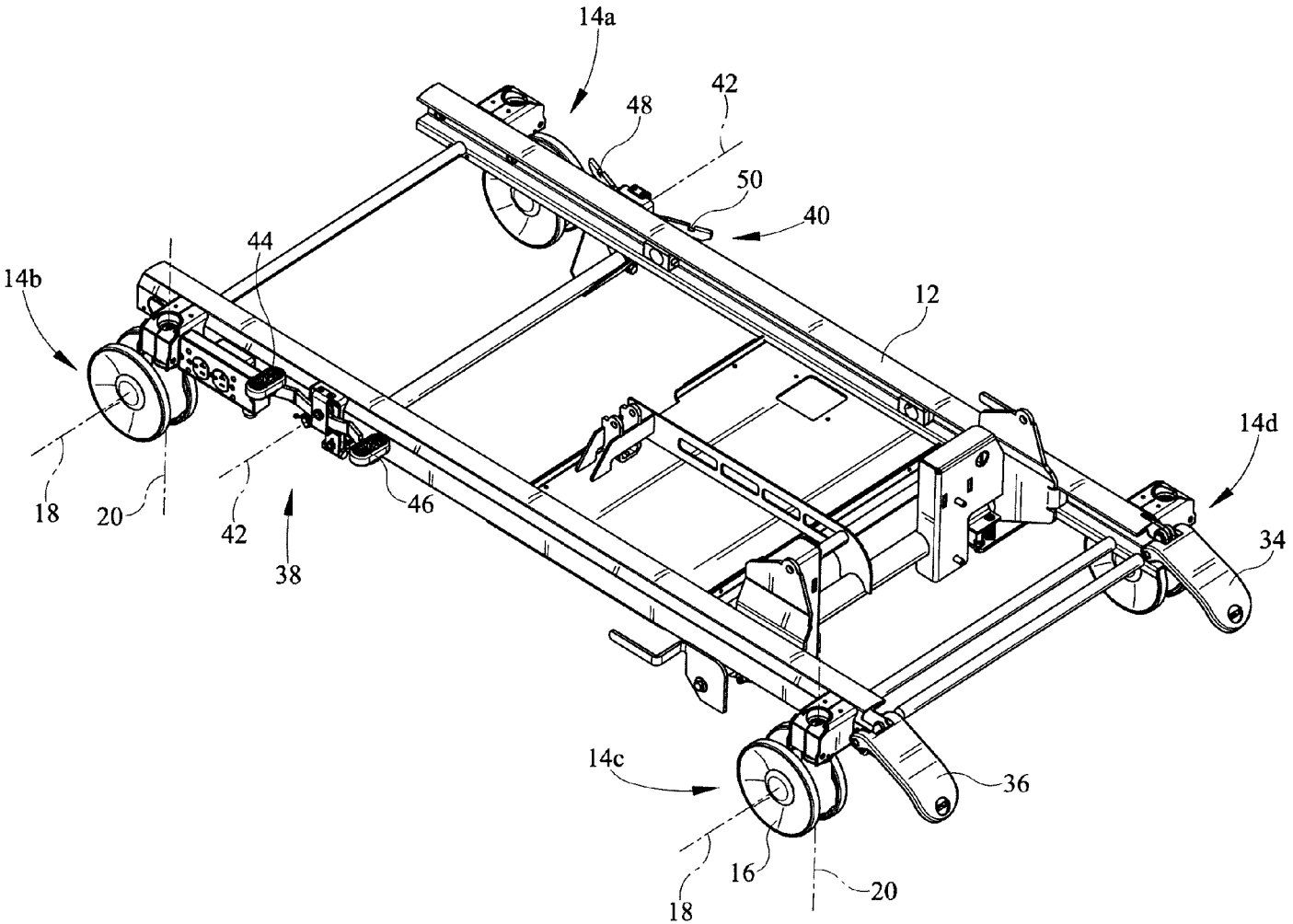
FIG. 2 is a perspective view of a first embodiment of a base including a frame and mechanism for changing a caster mode.

A patient support apparatus, such as a hospital bed 2, for example, includes a mattress 4, an articulated deck 6 with movable sections, an upper frame 8, a lift mechanism 10, and a base 12. The base 12 of the patient support apparatus 2 includes a number of casters 14*a*, 14*b*, 14*c*, and 14*d* as shown in FIG. 1. Referring now to FIG. 2, the casters 14*a*, 14*b*, 14*c*,

14*d* each have a brake mode in which a wheel 16 of each caster 14*a*, 14*b*, 14*c*, and 14*d* is locked to prevent rotation around a generally horizontal rotation axis 18 of each caster 14*a*, 14*b*, 14*c*, and 14*d*. In addition, a stem 22 of each caster 14*a*, 14*b*, 14*c*, and 14*d* is locked to prevent rotation about a vertical rotation axis 20 of each caster 14*a*, 14*b*, 14*c*, and 14*d*. The casters 14*a*, 14*b*, 14*c*, and 14*d* each have a neutral mode in which the caster wheels 16 are free to rotate about the axis 18 and the stem 22 is free to rotate about the axis 20. At least one of the casters 14*a* or 14*b* positioned at the foot end 24 of the base 12 include a steer mode wherein the caster wheel 16 is free to rotate about the axis 18, but the stem 22 is locked from rotation about the axis 20 so that the caster 14*a* and/or 14*b* maintains a tracking position to assist with steering the bed as it is pushed from the head end 26 of the bed by maintaining alignment of the axis 18 to be perpendicular to the longitudinal axis 30 of the base 12. When in the steer mode, the remaining casters 14*c*, 14*d*, and/or 14*a*, 14*b* are permitted to swivel about axis 20 and rotate about axis 18.

The base 12 may be used in place of the base structure shown in the patient support apparatus described in either U.S. application Ser. Nos. 12/891,909, filed Sep. 28, 2010 and titled "Hospital Bed with Chair Lockout" and 12/957,491, filed Dec. 1, 2010 and titled "Removable Integrated Board and Partial Foot Section," each of which is hereby incorporated by reference herein.

As will be discussed in further detail below, the brake mechanism of the bed 2 may include several embodiments, with certain elements of each embodiment being interchangeable to implement different input arrangements depending on the needs of a particular implementation.

Figure 3:
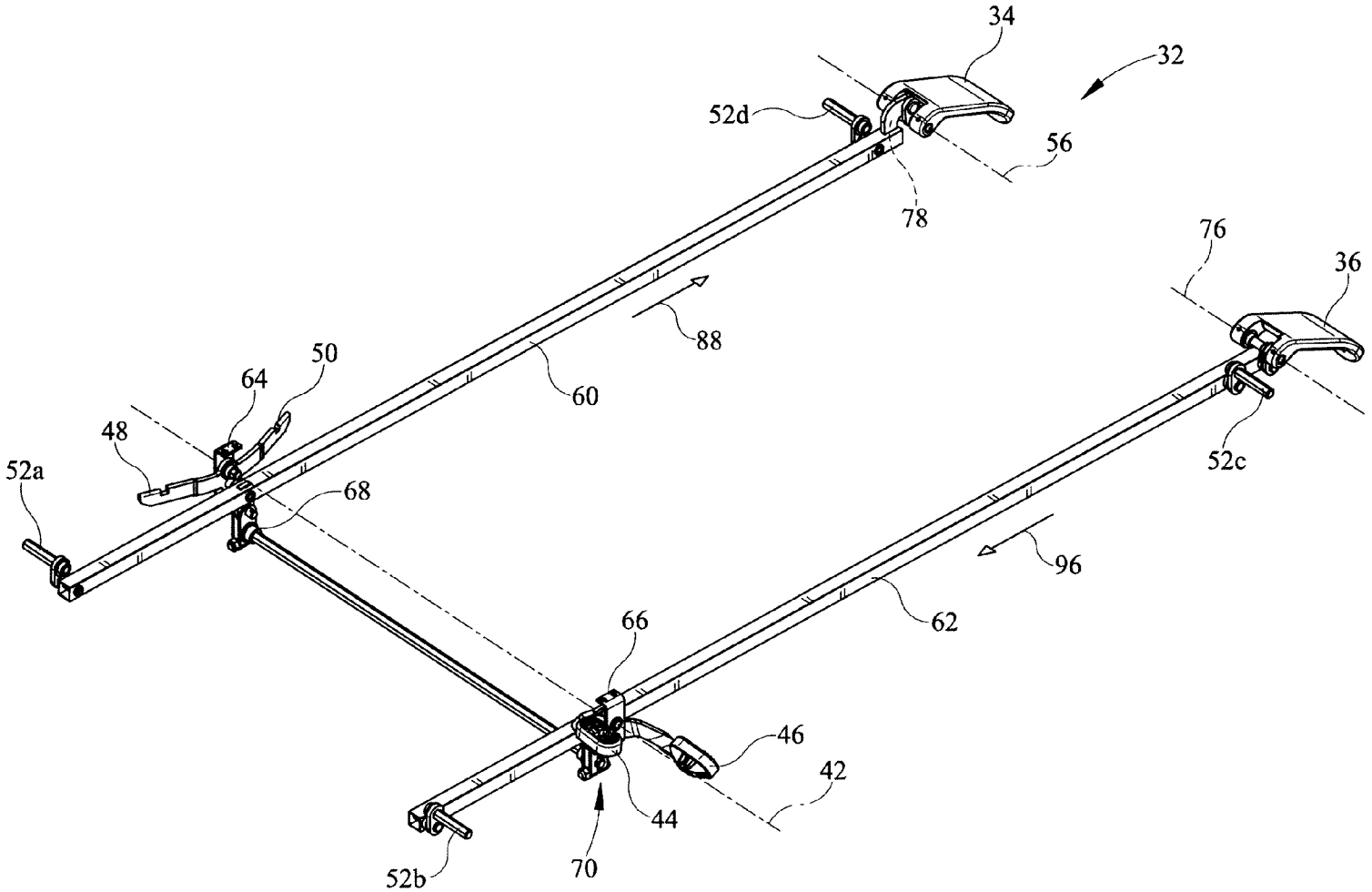
FIG. 3 is a perspective view of the mechanism FIG. 2.
Figure 4:
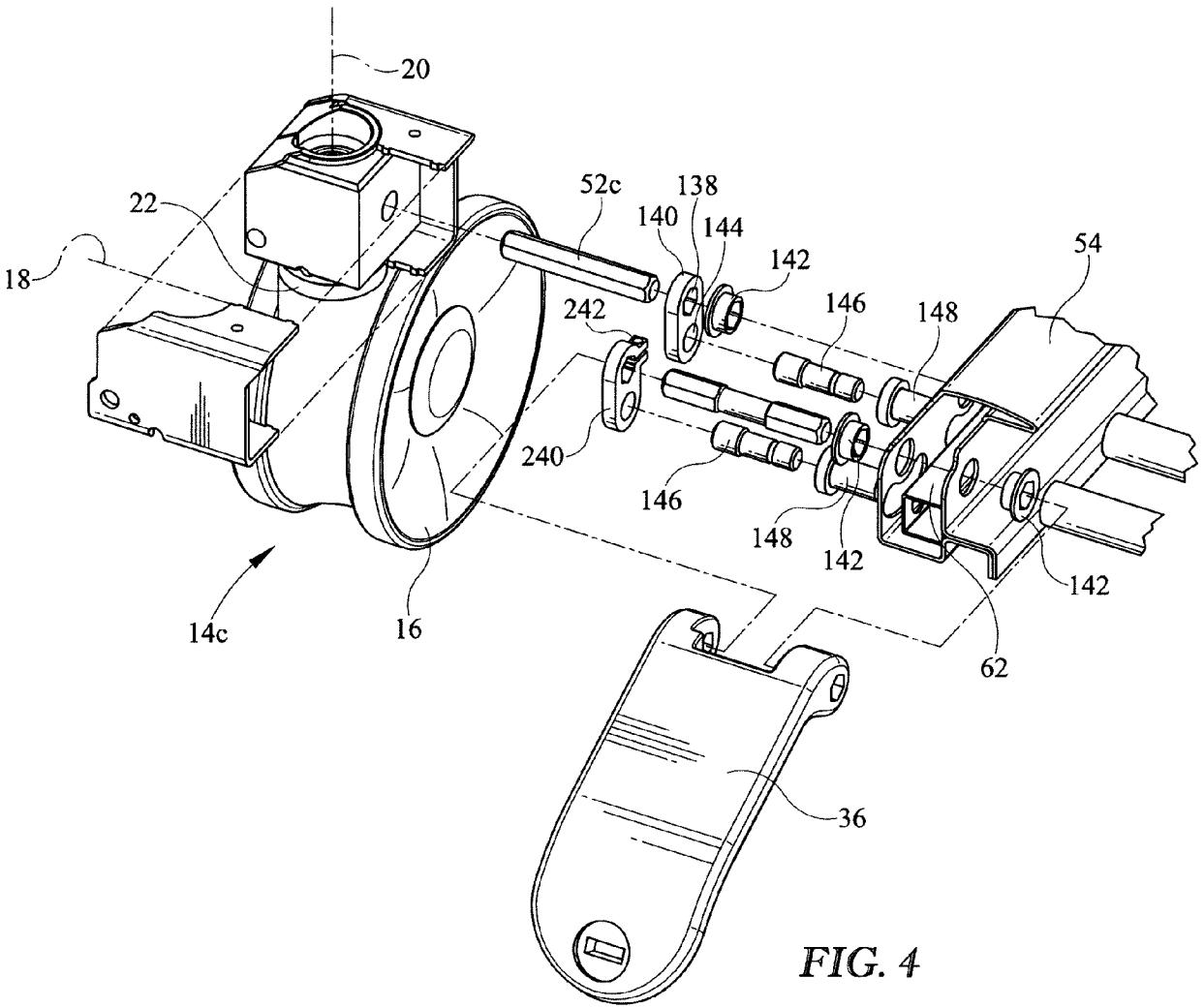
FIG. 4 is an exploded perspective view of one corner of the base of FIG. 2 and including a pedal actuable by a user and a caster that is actuated by the mode changing mechanism.
Figure 5:
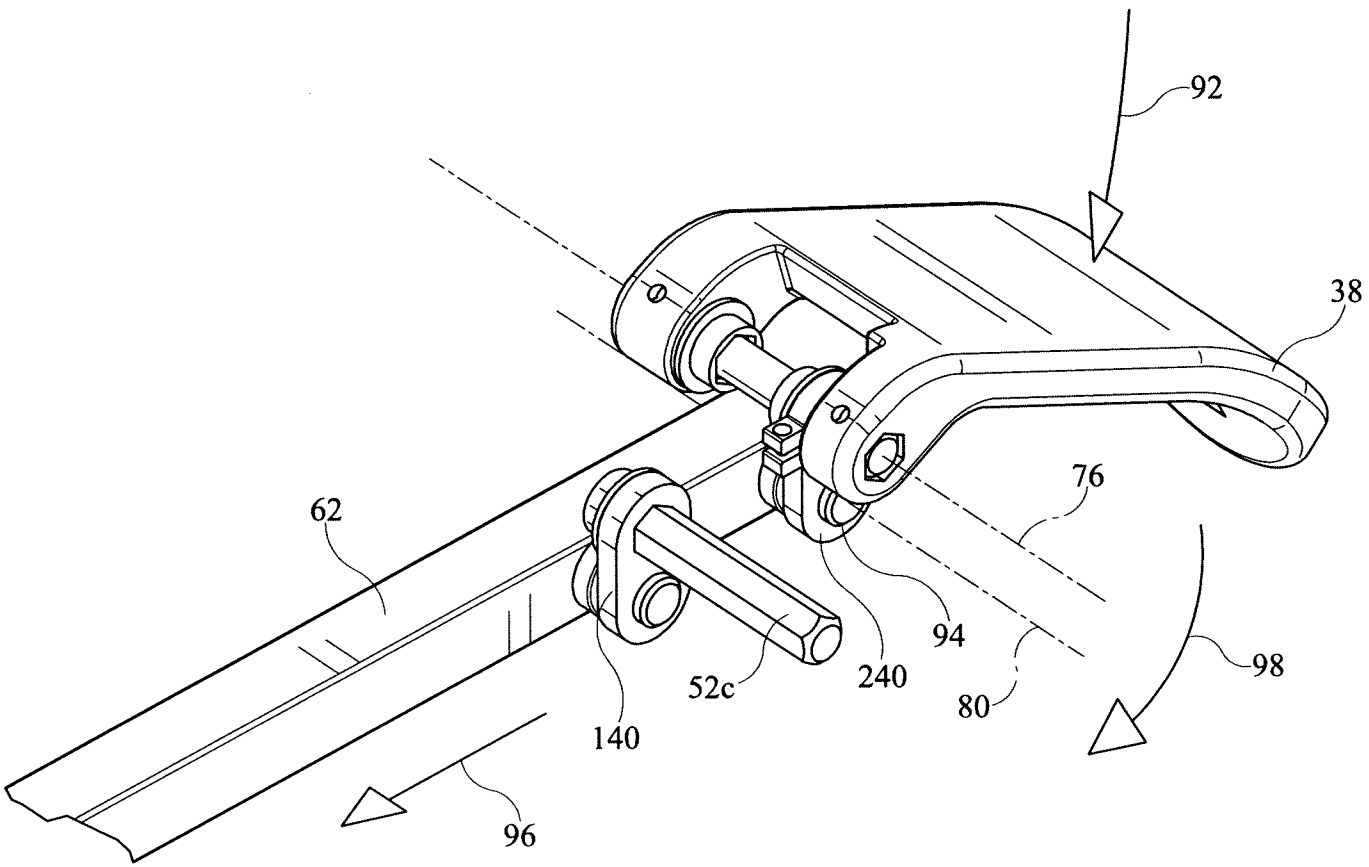
FIG. 5 is an enlarged view of a portion of FIG. 3.
Figure 6:
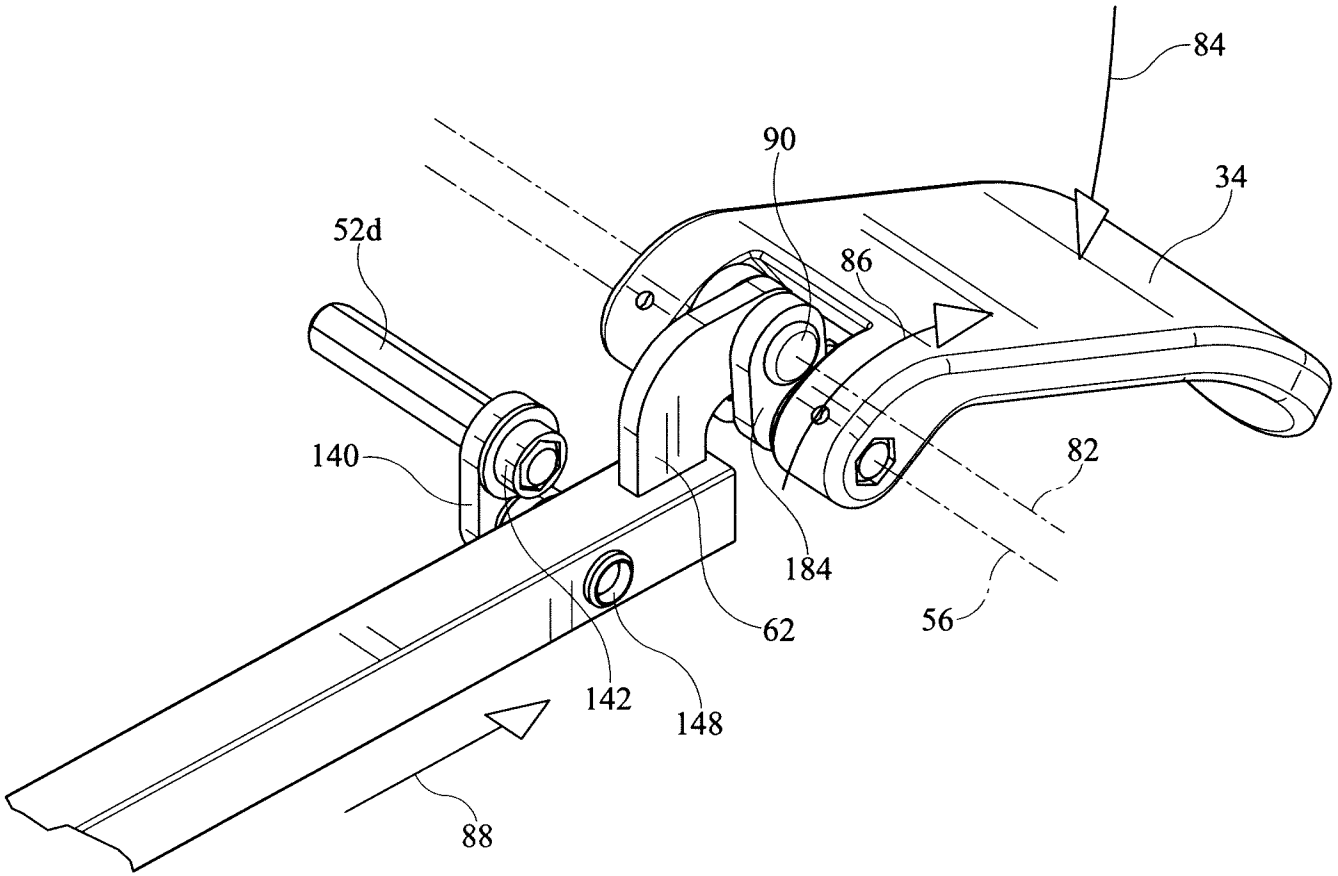
FIG. 6 is an enlarged view of a portion of FIG. 3.
Figure 7:
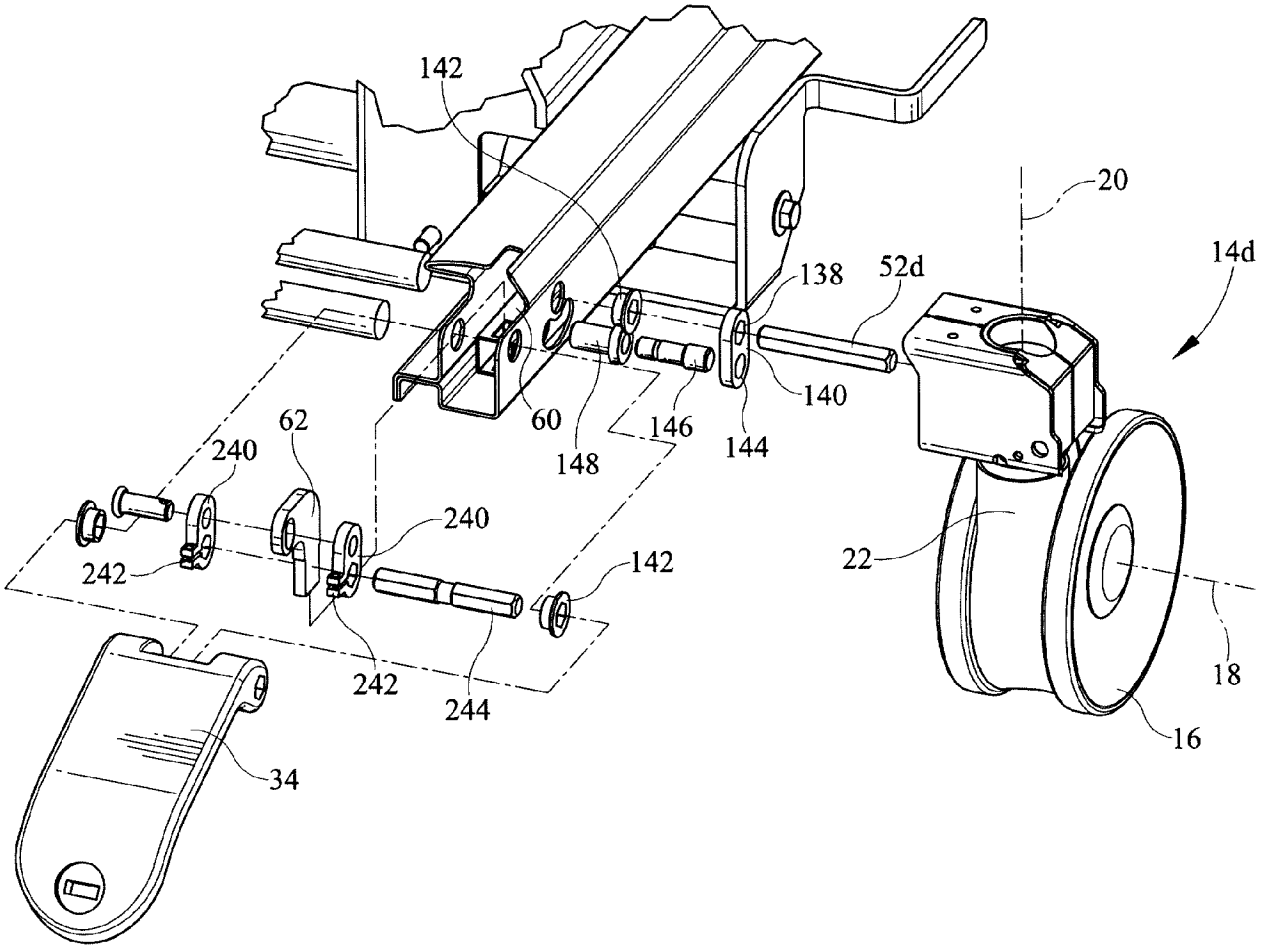
FIG. 7 is an exploded perspective view of yet another corner of the base of FIG. 2 and including a pedal actuable by a user and a caster that is actuated by the mechanism.
Figure 8:
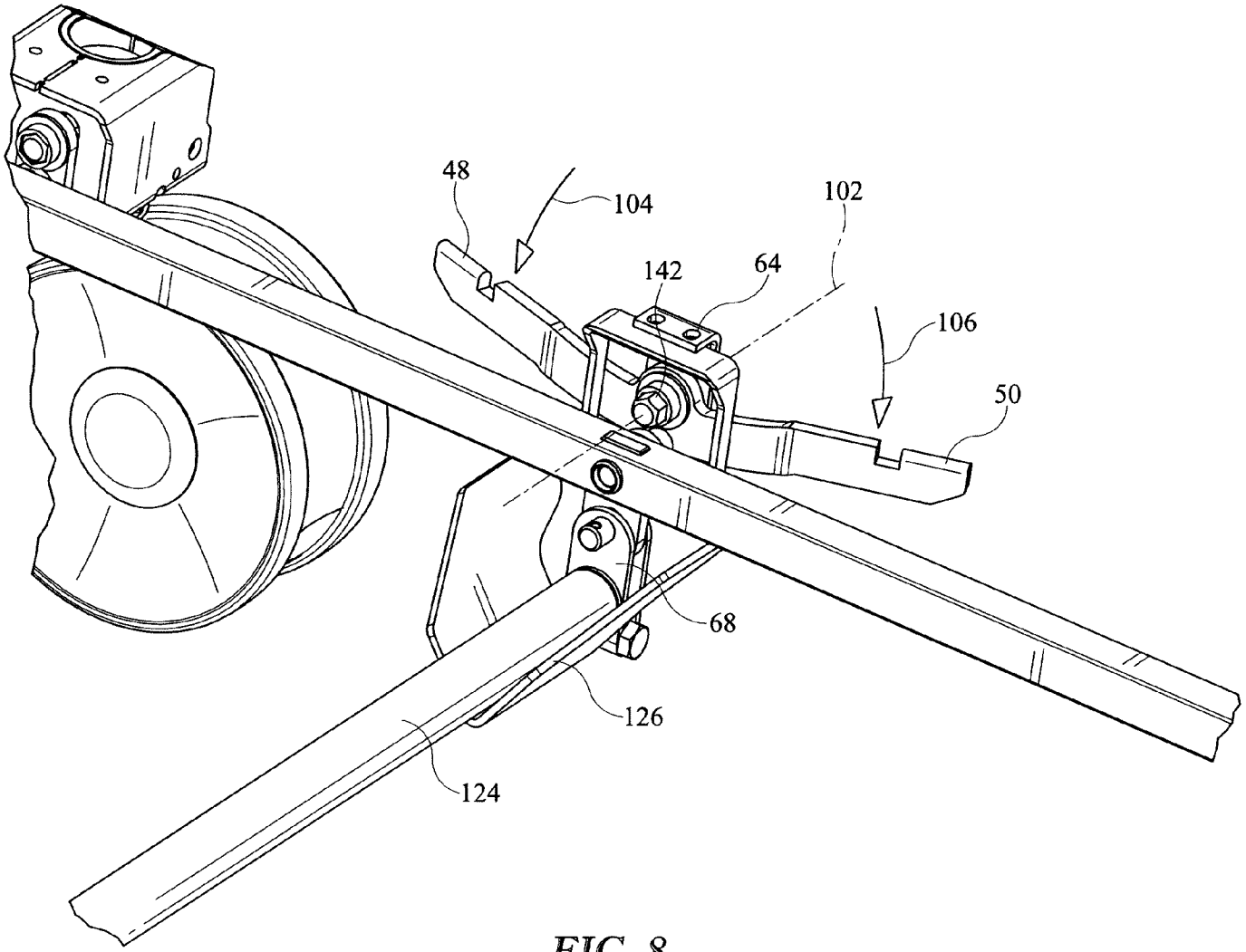
FIG. 8 is an enlarged perspective view of a portion of the frame and mechanism of FIG. 2.
Figure 9:
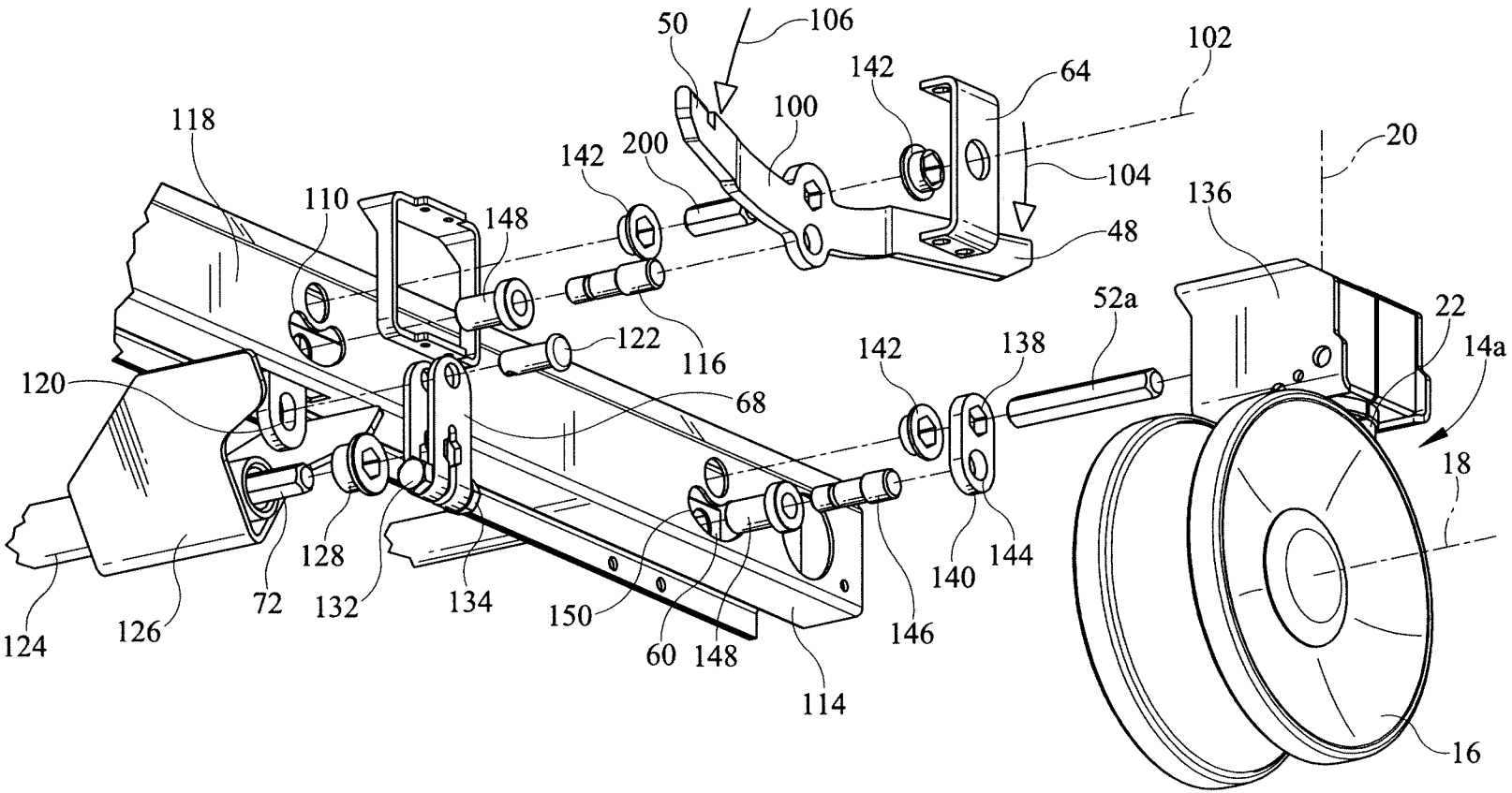
FIG. 9 is an exploded perspective view of still yet another corner of the base of FIG. 2 and including a pedal assembly actuable by a user positioned on a lateral side of the base and a caster that is actuated by the mechanism.

In a first embodiment, the base 12 includes a mechanism 32, shown in FIG. 3, which transfers motion between two pedals 34 and 36 positioned at the head end 26 of the base 12 and two pedal assemblies 38 and 40 positioned on lateral sides of the base 12. The pedal assemblies 38 and 40 are rotatable about a common axis 42. The pedal assembly 38 includes a pedal 44 positioned on one side of the pedal assembly 38 and a second pedal 46 positioned on the opposite side of the pedal assembly 38. The pedal assembly 40 includes a pedal 48 that corresponds to pedal 44 of pedal assembly 38. The pedal assembly 40 also includes a pedal 50 that corresponds to pedal 46 of the pedal assembly 38.

Depressing any one of the pedals 34, 36, 44, 46, 48, or 50 will cause the mechanism 32 to transfer motion from the depressed pedal throughout the mechanism 32 and to the other of the pedals 34, 36, 44, 46, 48, or 50. The mechanism 32 includes a number of hex shafts 52*a*, 52*b*, 52*c*, and 52*d* that engage to the respective casters 14*a*, 14*b*, 14*c*, and 14*d*. The casters 14*a*, 14*b*, 14*c*, and 14*d* include an internal mechanism which is actuated by rotation of the hex shafts 52*a*, 52*b*, 52*c*, and 52*d* to change the mode of the respective casters 14*a*, 14*b*, 14*c*, and 14*d* between the brake mode, neutral mode, and, if present, steer mode. The hex shafts 52*a*, 52*b*, 52*c*, and 52*d* each function as a mode change key, with rotation of a hex shaft 52*a*, 52*b*, 52*c*, or 52*d* changing the mode of the respective caster 14*a*, 14*b*, 14*c*, or 14*d*. An example of an illustrative caster 14*a*, 14*b*, 14*c*, and 14*d* is shown in Mobley et al., U.S. Pat. No. 6,321,878. Other casters may be used within the scope of this disclosure as will be understood by those of skill in the art.

The mechanism 32 includes two longitudinal arms 60 and 62 that are interconnected and supported by the pedals 34 and 36 and by a pair of brackets 64 and 66 so that the mechanism 32 is movable relative to a frame 54 of the base 12. Two brackets 68 and 70 depend from the respective arms 60 and 62 and are interconnected by a cross-bar 72 so that motion of one arm 60, 62 is transferred to the other of the arms 60, 62.

The frame 54 of the base 12 acts as a ground for the mechanism 32 so that components of the mechanism 32 move relative to the frame 54. The pedal 34 is pivotable relative to the frame 54 about an axis 56 and the pedal 36 is pivotable relative to the frame 54 about an axis 76. The arm 60 includes a flange 78 and the pedal 34 is pivotably coupled to the flange 78 at an axis 82. The axis 56 and the axis 76 are generally collinear. The pedal 36 includes a link 184 that is pivotably coupled to the arm 62 at an axis 80.

In operation, axis 56 and axis 76 are the ground point for the mechanism with the axis 82 being positioned above the axes 56 and 76 and the axis 80 positioned below the axes 56 and 76. The axis 56 acts as a fulcrum point for pedal 34 and the axis 76 acts as a fulcrum point for pedal 36. When a downward force is applied to the pedal 34 as indicated by arrow 84, the pedal tends to rotate about axis 56 with the force being transferred to a pin 90 at axis 82 so that the pin 90 is urged toward the head end 26 of the base 12 as indicated by arrow 86. A shaft 244 is positioned at the axis 56 and a pair of links 240 are coupled to shaft 244 and engaged by a pin 90. The arm 62 includes an oval aperture 242 that allows some lost motion between the pin 90 and the arm 62. The shaft 244 is supported on the frame 54 by two bearings 142. The links 240 each include a clamp that is used to secure the links 240 to the shaft 244. This causes the arm 60 to be moved in the direction of arrow 88. This motion is transferred throughout the mechanism 32 as will be discussed in further detail below. Similarly, the application of a force to the pedal 38 as represented by arrow 92 causes a pin 94 at axis 80 to be urged toward the foot end 24 of the base 12 as represented by a curved arrow 98. This motion is transferred through the pin 94 to the arm 62 and the arm 62 is urged in the direction of arrow 96. Thus, the force in the direction of arrow 92 acts on the mechanism 32 in a direction opposite the direction 84. Because the axis 82 is above the fulcrum point of pedal 34 and axis 80 is below the fulcrum point of pedal 38, the mechanism moves in opposite directions.

The pedal assemblies 38 and 40 are coupled to the arms 62 and 60 respectively. Referring now to pedal assembly 40, a pedal arm 100 is pivotably coupled to the bracket 64 and pivotable about an axis 102. A hex shaft 200 is engaged with the pedal arm 100 and supports the mechanism 32 for movement relative to the frame 54 of the base 12. A bearing 142 is engaged with the bracket 64 and receives one end of the hex shaft 200. A second bearing 142 is engaged with the outer wall 112 of the tube 114 of the frame 54. A cut-out 110 formed in the outer wall 112 of the tube 114 of the frame 54 permits movement of a pin 116 that couples the pedal arm 100 to the longitudinal arm 60. The pin 116 is supported in a bearing 148 that is received in the wall 112. When force is applied to pedal 48 as indicated by arrow 104, the mechanism 32 is moved in the direction of arrow 88. When a force is applied to pedal 50 as indicated by arrow 106, the mechanism 32 is moved in the direction of arrow 96. Thus, force in the direction 104 corresponds to a force in the direction 84 and a force in the direction of arrow 106 corresponds to a force in the direction of arrow 92 in terms of causing movement of the mechanism 32.

The mechanism 32 includes flange 118 that is coupled to the arm 60 to move therewith. The flange 118 includes an oval shaped aperture 120 that has a longitudinal length that is aligned vertically. A pin 122 secures the flange 118 to the bracket 68 with the bracket 68 being secured to the cross-bar 72. When the mechanism 32 is in the neutral position shown in the figures, the pin 122 is positioned in the upper most portion of the aperture 120. Movement of the mechanism 32 in either direction 88 or 96 causes the flange 118 to move and act on the pin 122. The movement of the pin 122 causes the bracket 68 to pivot relative to a support tube 124 that supports the cross-bar 72. The support tube 124 is secured to v-shaped bracket 126 that is secured to the tube 114 of the frame 54 of the base 12. The cross-bar 72 is supported in a bearing 128 that rotates relative to the support tube 124 such that the cross-bar 72 transfers movement of the pedal assembly 40 to a similar structure on the opposite side of the frame 54 so that motion of the pedals 48 and 50 is transferred to the pedals 34, 36, 44, and 46. The cross-bar 72 is hex-shaped and the bracket 68 includes a hex shaped opening 130 to secure the bracket 68 to the cross-bar 72 with a bolt 132 and a nut 134 used to clamp the bracket 68 to the cross-bar 72.

The motion of the mechanism 32 transfers rotation to the hex shafts 52*a*, 52*b*, 52*c*, and 52*d* in a similar manner, so the discussion will focus on the operation of caster 14*a* and hex shaft 52*a*. The caster 14*a* is supported in a caster post 136 that is secured to the tube 114. The hex shaft 52*a* is engaged with a hex shaped aperture 138 formed in a link 140. A bearing 142 is received in the wall of the tube 114 and supports the hex shaft 52*a* for rotation relative to the base 12. The bearing 142 also bears against the link 140 as it rotates. The link 140 also includes a circular aperture 144 that is positioned below the hex shaped aperture 138 when the mechanism 32 is in the neutral position. A pin 146 is received in the aperture 144 and is free to rotate relative to the link 140. The pin 146 is also received in a bearing 148 that is secured to the arm 60. An aperture 150 is formed in the wall of tube 114 to provide clearance for movement of the pin 146 as it rotates about the hex shaft 52*a*. The hex shaft 52*a* provides a ground point for the mechanism 32 to support at least a portion of the mechanism 32 as it moves relative to the frame 54. As the mechanism moves in the direction of arrow 88, the hex shaft 52*a* is rotated in the direction of arrow 152 and as the mechanism moves in the direction of arrow 96, the hex shaft 52*a* is moved in the direction of arrow 154.

Because casters 14*b* and 14*c* are positioned on the opposite side of the frame 54 from the casters 14*a* and 14*d*, the motion transferred to the casters 14*a*, 14*b*, 14*c*, and 14*d* is effectively the same action on the internal mechanism if the casters 14*a*, 14*b*, 14*c*, and 14*d*.

It should be noted that pedal assemblies 38 and 40 have pedal covers such as those shown on pedal 44 and 46 respectively, with the pedal covers omitted from pedals 48 and 50. The pedal covers are color codes so that a user may readily recognize the resulting action from stepping on one of the pedals 44, 46, 48, and 50. Similarly, pedals 34 and 36 are color coded so that a user will recognize that pedals 34, 50, and 46 all result in the same action, such as activating the brake mode, for example, and pedals 36, 44, and 48 all result in the same action, such as activating the steer mode, for example. With this configuration, a user may step on pedal 34 to move the casters to a first non-neutral mode from the neutral mode. A user may then step on pedal 36 to return to the neutral mode or with continued actuation, move the casters to a second, non-neutral mode.

Figure 10:
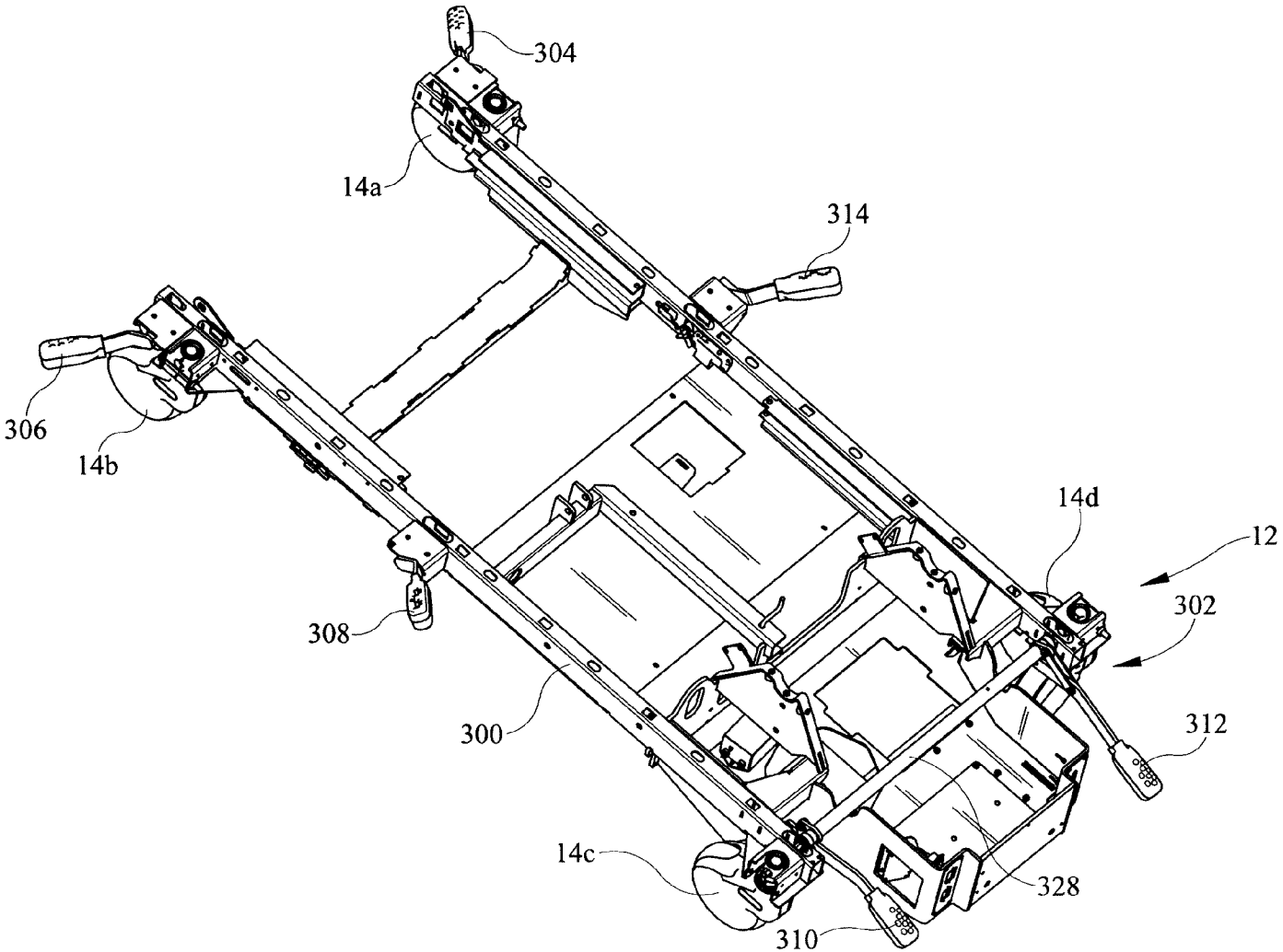
FIG. 10 is a perspective view of another embodiment of a base including a frame and a mode changing mechanism for changing the mode of the casters supporting the base.

In another embodiment shown in FIG. 10, the base 12 includes a frame 300 and a mechanism 302 that includes six pedals 304, 306, 308, 310, 312, and 314. The pedals 304, 306, 308, 310, 312, and 314 are interconnected through the mechanism 302 as will be discussed in further detail below. In general, the principle of transferring motion through translating the two arms 60 and 62 as disclosed in the embodiment of FIGS. 2-9 is carried forward, with modified linkages that transfer movement between the pedals 304, 306, 308, 310, 312, and 314 and two arms 316 and 318 of the mechanism 302 shown in FIG. 11.

Figure 11:
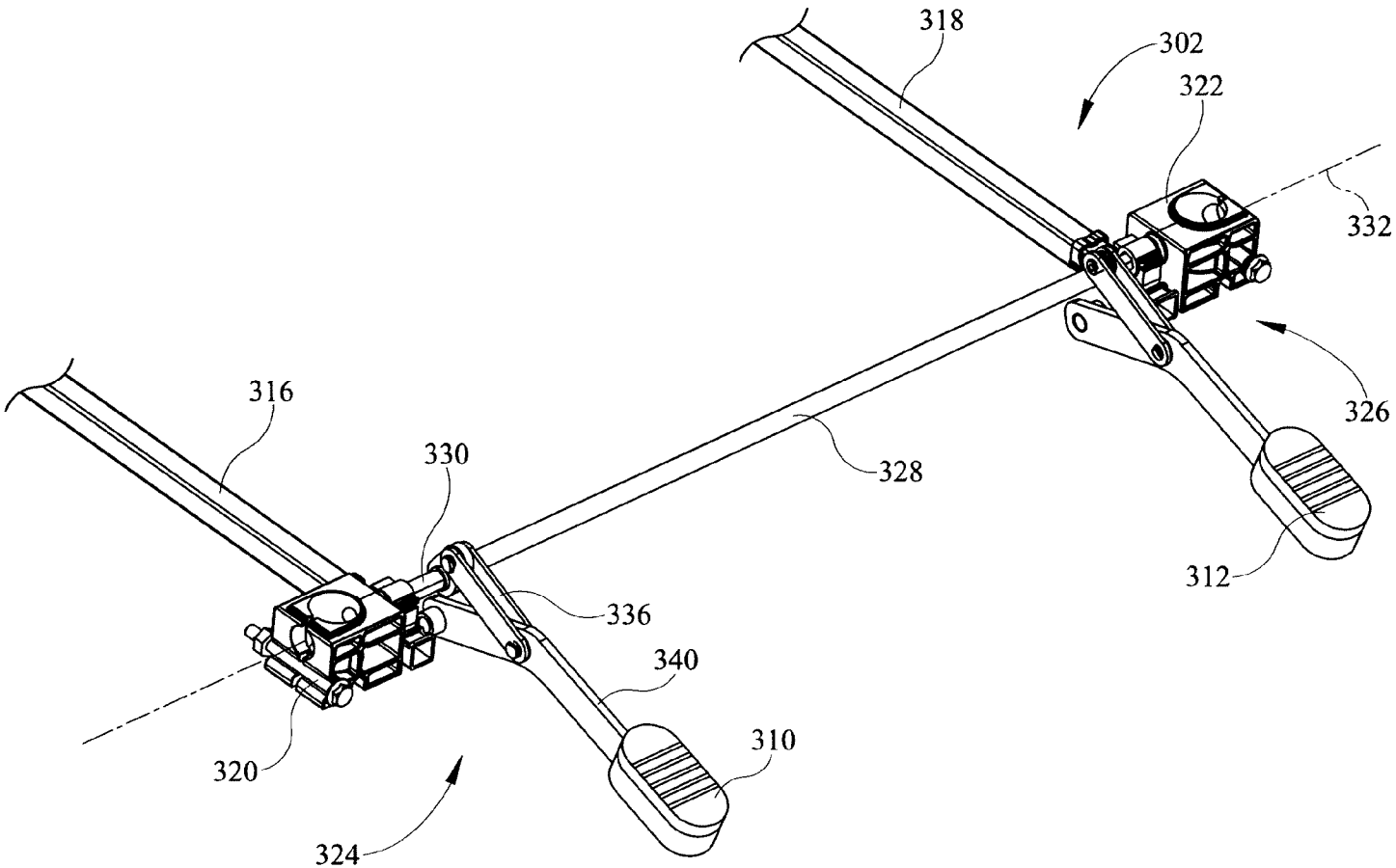
FIG. 11 is a perspective view of a portion of the mode changing mechanism of the embodiment of FIG. 10.

In the embodiment of FIG. 11, the two pedals 310 and 312 are configured to move together and in the same direction. As will be discussed in further detail below, the mechanism 302 may be configured such that the motion of the pedals 310 and 312 may be complementary, with pedal 310 moving in first vertical direction while the pedal 312 moves in the opposite vertical direction.

As shown in FIG. 11, two caster sockets 320 and 322, which are part of the frame 300, are positioned to engage the casters 14*c* and 14*d* (not shown in FIG. 11) to support the remainder of the frame 300. The pedal 310 is an input to an actuation mechanism 324 and the pedal 312 is an input to an actuation mechanism 326, the actuation mechanisms 324 and 326 transferring motion from the respective pedals 310 and 312 to move the arms 316 and 318. The actuation mechanisms 324 and 326 are interconnected by a transfer bar 328 which transfers movement from one of the actuation mechanisms 324, 326 to the other of the actuation mechanisms 324, 326.

Figure 12:
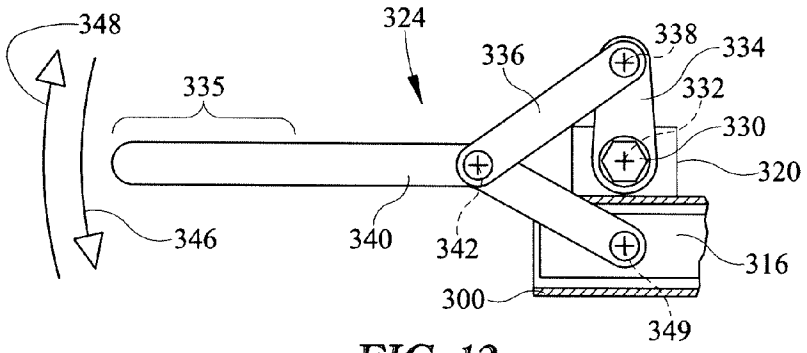
FIG. 12 is a diagrammatic view of another embodiment of an actuation mechanism for the mode changing mechanism of the embodiment of FIG. 10; the actuation mechanism in a first position.

Referring now to FIG. 12*a*, in a first, neutral position, the actuation mechanism 324 is supported from a hex shaft 330 that engages caster 14*c* (not shown) and rotates about an axis 332 to change the mode of the caster 14*c*. Because the hex shaft 330 is received in a hex member of the caster 14*c*, the hex shaft 330 is keyed to the caster 14*c* and acts as a mode key. A follower 334 is supported from the hex shaft 330 and rotates with the hex shaft 330. A control arm 336 is pivotably coupled to the follower 334 at an axis 338 such that the control arm 336 and the follower 334 have pivoting relative motion therebetween. The control arm 336 is also pivotably coupled to an actuator 340 at an axis 342 and pivots relative to the actuator 340. The actuator 340 has a force receiving area 344 where the pedal 310 is mounted so that force applied to the pedal 310 is transferred to the actuator 340. The actuator 340 may receive a force in a downward direction as represented by arrow 346 or an upward direction as represented by arrow 348. In either case, the force applied will be transferred through the actuation mechanism 324. The actuator 340 is also pivotably coupled to the transfer arm 316 at an axis 349.

The transfer bar 328 is coupled to the follower 334 and is centered on the axis 332 to transfer rotation of the hex shaft 330 and follower 334 to the actuation mechanism 326 as will be described in further detail below. In addition, if the actuation mechanism 326 receives an input, movement of the actuation mechanism 326 will be transferred to the actuation mechanism 324 through the transfer bar 328.

Figure 13:
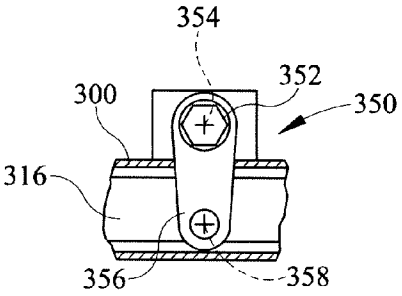
FIG. 13 is a diagrammatic view of yet another embodiment of an actuation mechanism complementary to the actuation mechanism of FIG. 12, the actuation mechanism shown in a first position.

In the illustrative embodiment of FIG. 11, the actuation mechanism 326 is a mirror image of the actuation mechanism 324 and moves with actuation mechanism 324 with pedal 312 raising and lowering with pedal 310. The actuation mechanisms 324 and 326 are supported from their respective hex rods with the arms 316 and 318 supported from the actuation mechanisms 324 and 326. In one embodiment, arm 316 is supported from an actuation mechanism 350 that is associated with the pedal 308. The pedal 308 acts on a hex rod 352 shown in FIG. 12*b* which supports a follower 356. The follower 356 is keyed to the hex rod 352 in both the follower 356 and the hex rod 352 rotate about an axis 354. The follower 356 is pivotably coupled to the arm 316 at an axis 358. Thus, in the embodiment shown in FIGS. 12 and 13, the arm 316 is supported by the actuation mechanism 324 and the actuation mechanism 350. The arm 318 would similarly be supported from the actuation mechanism 326 and a mirror image of the actuation mechanism 350. With the transfer bar 328 interconnecting the actuation mechanisms 324 and 326, it should be understood that the mechanism 302 is supported for movement relative to the frame 300 and can be acted upon by any of the pedals 308, 310, 312, or 314. Movement of any one of the pedals 308, 310, 312, or 314 will be transferred through the mechanism 302 two each of the other of the pedals 308, 310, 312, and 314.

It should be understood that in some embodiments, actuation mechanism 350 may be supported from the caster 14*b* such that the hex rod 352 is operable to change the mode of caster 14*b*.

Figure 14:
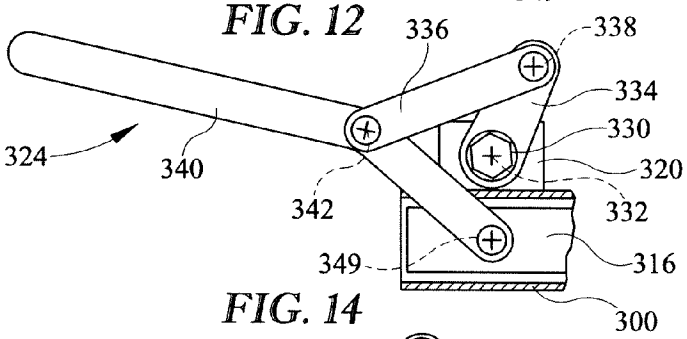
FIG. 14 is another diagrammatic view of the embodiment of FIG. 12, the actuation mechanism in a second position.

Referring now to FIG. 14, the actuation mechanism 324 is shown with the mode of the casters modified by movement of the mechanism 302. As shown in FIG. 14, a force has been applied to the area 335 of the actuator 340 in an upward direction 348 such that the actuator has pivoted about axis 349 relative to the arm 316. The force applied to the actuator 340 results in a moment about axis 342. The force is transferred to the arm 316 and the control arm 336 with the arm 316 being constrained by the follower 356 shown in FIG. 15. The actuation mechanism 324 and actuation mechanism 350 reacts to the force applied to the area three and 34 with moments created about axis 332 and axis 354 so that the force applied results in rotation of the hex shafts 330 and 352 to change the mode of the casters from the centered position shown in FIGS. 12 and 13 to the first offset position shown in FIGS. 14 and 15. The motion is also transferred through the transfer bar 328 to the actuation mechanism 326 so that the arm 318 moves in cooperation with the arm 316 to change the mode of the casters 14*a* and 14*d*.

Figure 15:
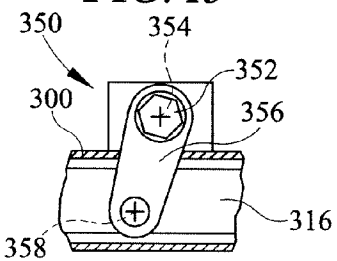
FIG. 15 is another diagrammatic view of the embodiment of FIG. 13, the actuation mechanism in a second position.
Figure 16:
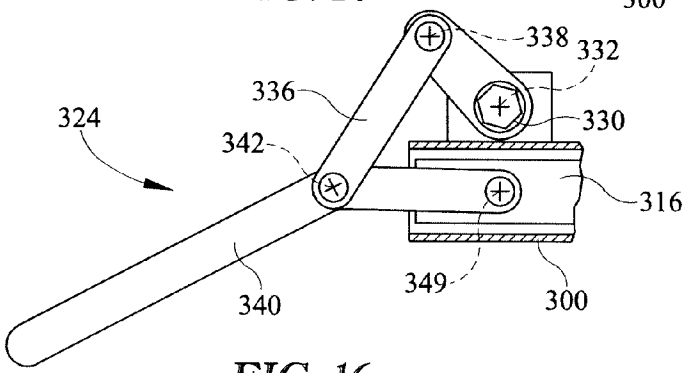
FIG. 16 is another diagrammatic view of the embodiment of FIG. 12, the actuation mechanism in a third position.
Figure 17:
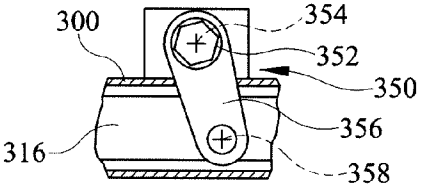
FIG. 17 is another diagrammatic view of the embodiment of FIG. 13, the actuation mechanism in a third position.

FIGS. 16 and 17 illustrate the resulting motion that occurs when a force is applied downwardly as indicated by arrow three under 46 to the area 335 creating moments about the hex shafts 330 and 352 in a direction opposite that shown in FIGS. 14 and 15 with the arm 316 moving in the opposite direction to change the mode of the casters to the second offset position shown in FIGS. 16 and 17. It should be understood that the operation of the mechanism 302 relies on the constraints of the actuation mechanism 350 about axis 354 and the actuation mechanism 324 about the axis 332. It should be noted that the arms 316 and 318 do not move in a purely linear motion, but do approximate a linear motion as the actuation mechanism 324 or actuation mechanism 350 receives in the input force by shifting longitudinally along the frame 300.

Figure 18:
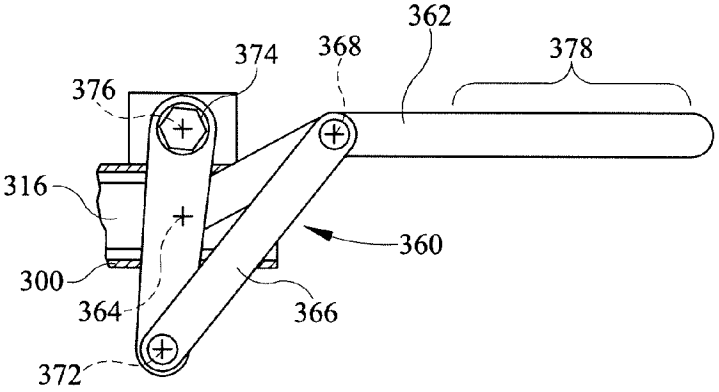
FIGS. 18-20 are diagrammatic views of yet another embodiment of an actuation mechanism in three different positions.
Figure 19:
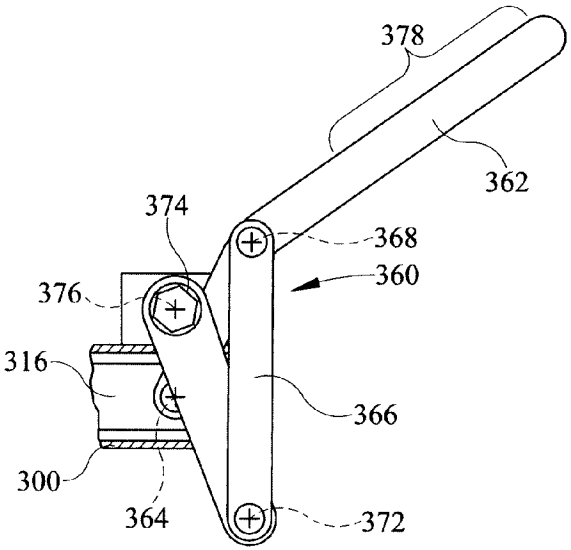
Figure 20:
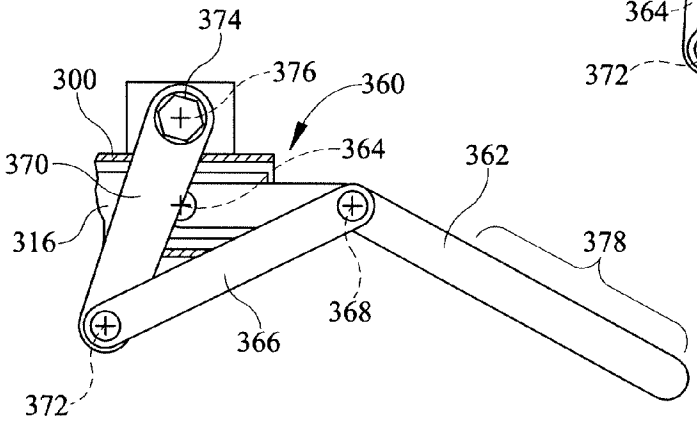

Referring now to FIGS. 18-20, another embodiment of an actuation mechanism 360 is shown. The actuation mechanism 360 includes an actuator 362 that is pivotably coupled to the transfer arm 316 at an axis 364. The actuation mechanism 360 further includes a control arm 366 that is pivotably coupled to the actuator 362 at an axis 368 and pivotably coupled to a follower 370 at an axis 372. The follower 370 is secured to a hex rod 374 which pivots about an axis 376 such that both the follower 370 and hex rod 374 rotate together about axis 376.

The actuator 362 includes a force receiving area 378 which corresponds to the pedal 306 in the embodiment of FIG. 10. It should be evident to those of ordinary skill in the art that the pedal 306 when used with actuation mechanism 360 will raise when the transfer arm 316 moves away from the force receiving area 378 because the follower 370 depends downwardly from the hex rod 374. This should be contrasted to the actuation mechanism 324 in which the force receiving area 335 moves up when the transfer arm 316 moves toward the force receiving area 335. When the actuation mechanism 324 and the actuation mechanism 360 are placed at opposite ends of the same transfer arm, such as transfer arm 316, the movement of the respective pedals 310 and 306 is coordinated so that each moves in the same vertical direction. This is principally a result of the relationship of the orientation of the follower 334 or 370 relative to the respective hex rod 330 or 374.

Figure 23:
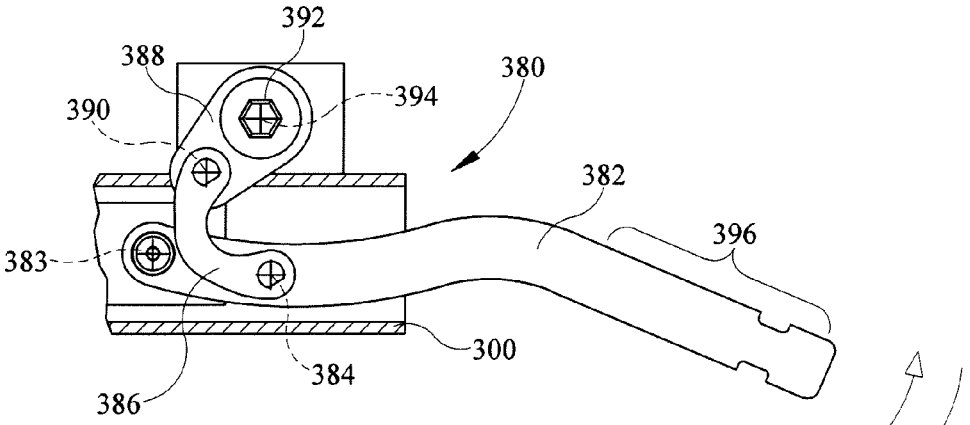
FIGS. 21-23 are diagrammatic views of yet another embodiment of an actuation mechanism in three different positions.
Figure 21:
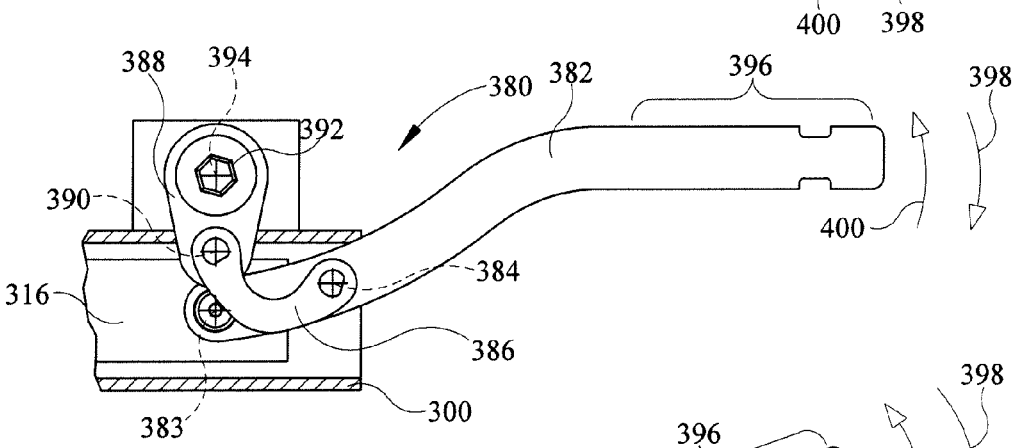
Figure 22:
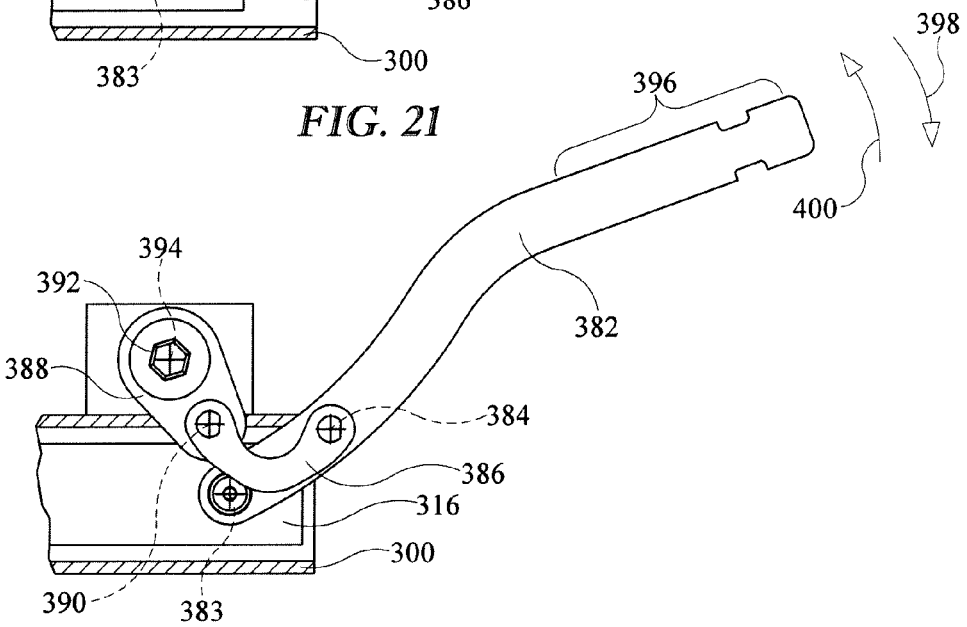

In yet another embodiment of an actuation mechanism 380 shown in FIGS. 21-23, a more compact linkage assembly is achieved based on the location of the pivot axes of the respective links and the shape of a control arm 386 which is pivotably coupled to an actuator 382 at an axis 384. The control arm 386 is also pivotably coupled to a follower 388 at an axis 390. The actuator 382 is pivotably coupled to the transfer arm 316 at an axis 383. The follower 388 is pivotably coupled to a hex rod 392 and pivots with the hex rod 392 about an axis 394. The actuation mechanism 380 has a force receiving area 396 that can receive either an upward 398 or downward force 400.

The actuation mechanism 380 can be used as a direct replacement for the actuation mechanism 360 as the relationship between the motion of the actuator 382 and the transfer arm 316 is similar to that of the actuator 362 in the actuation mechanism 360.

Figure 24:
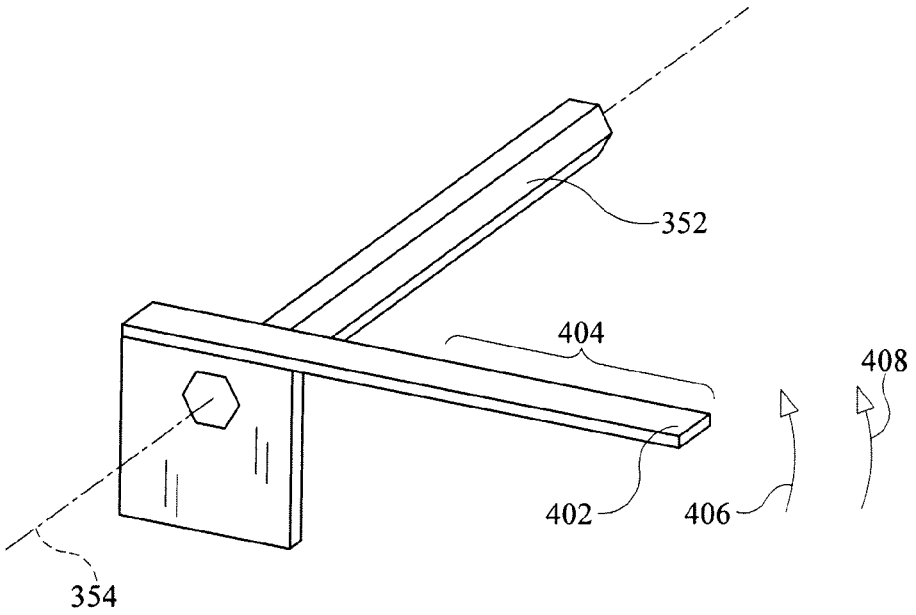
FIG. 24 is a diagrammatic view of an embodiment of an input assembly suitable for use with the actuation mechanism shown in FIGS. 13, 15, and 17.

Referring to FIG. 24, an actuation mechanism 350 may include an actuator 402 that is offset from the hex rod 352 with a force receiving area 404 that may receive either an upward 406 or downward 408 directed force to cause the rotation of the hex rod 352. The force of applied to the force receiving area 404 induces a moment about axis 354 which causes the hex rod 352 to rotate and is transferred throughout the mechanism 302. The force receiving area 404 corresponds to the location of pedal 308 in FIG. 11. It should be understood that pedal 314 may utilize a structure that is a mirror image of the actuator 402 and provide an input to an actuation mechanism that is a mirror image of the actuation mechanism 350.

Figure 25:
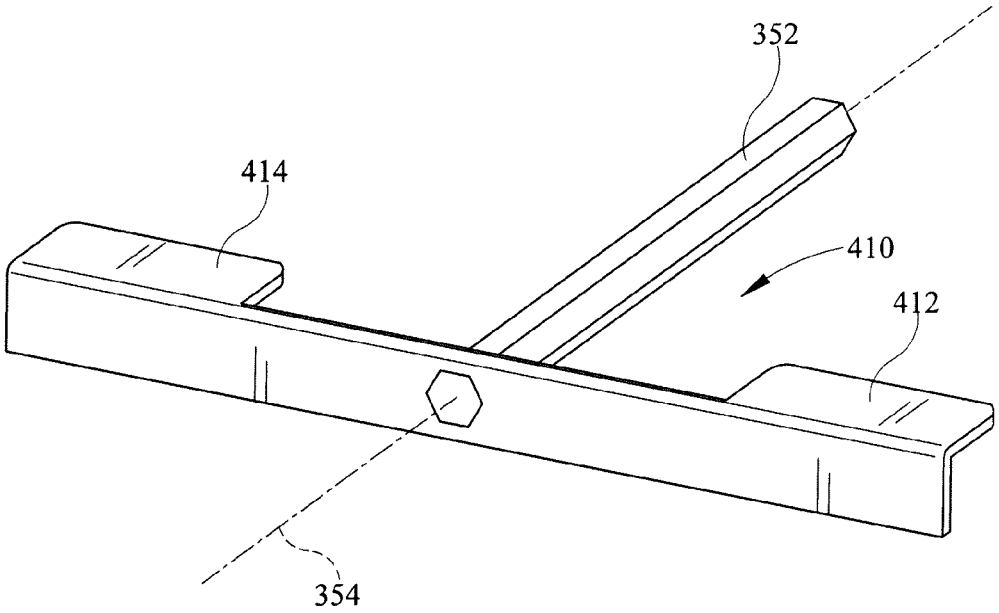
FIG. 25 is a diagrammatic view of yet another embodiment of an input assembly suitable for use with the actuation mechanism shown in FIGS. 13, 15, and 17.

In other embodiments, an actuator 410 may be coupled to the hex rod 352 as shown in FIG. 25. The actuator 410 includes opposing force receiving areas on opposite sides of the axis 354 so that a user may apply a downward force to a force receiving area 412 to rotate the hex rod 352 in a first direction and apply a downward force to a force receiving area 414 to rotate the hex rod 352 in a second direction, opposite the first direction.

Figure 26:
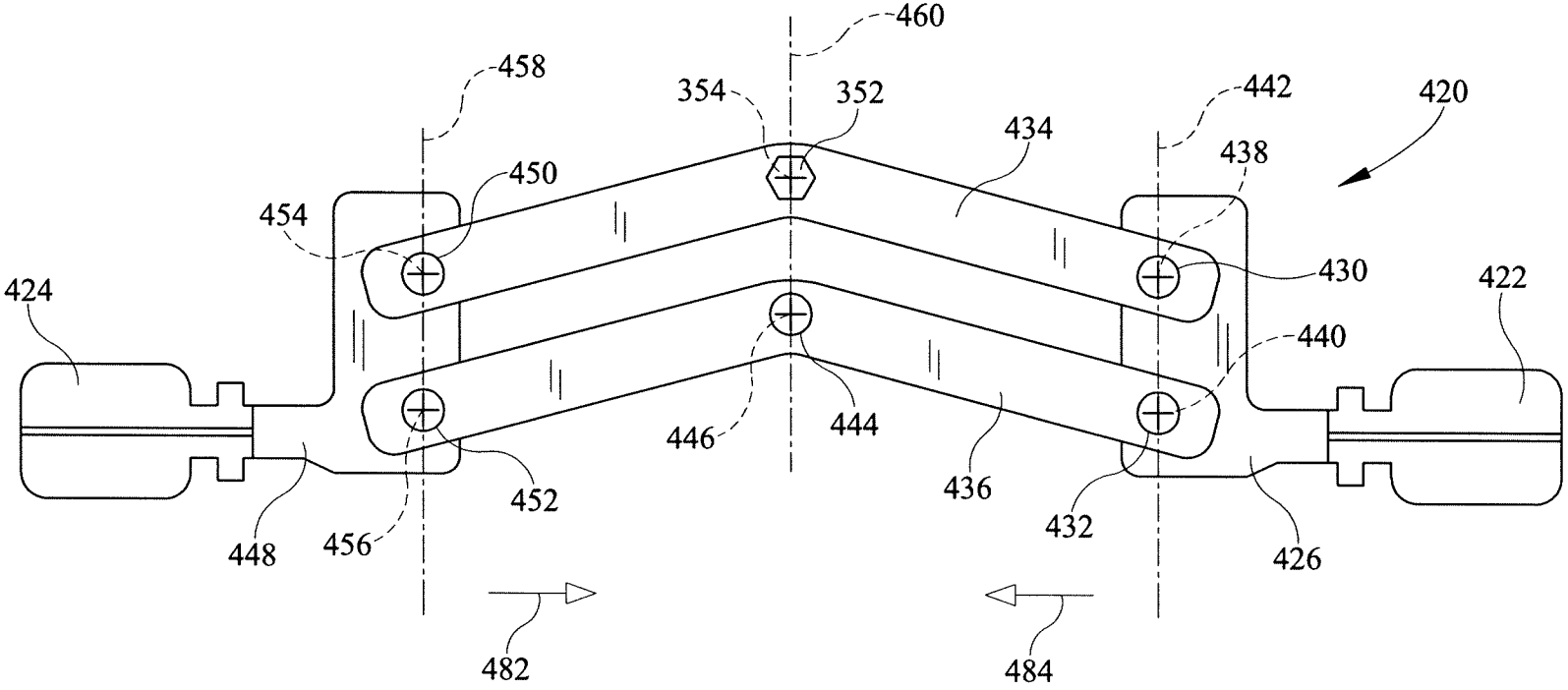
FIG. 26 is a diagrammatic view of still yet another embodiment of an input assembly suitable for use with the actuation mechanism shown in FIGS. 13, 15, and 17.
Figure 27:
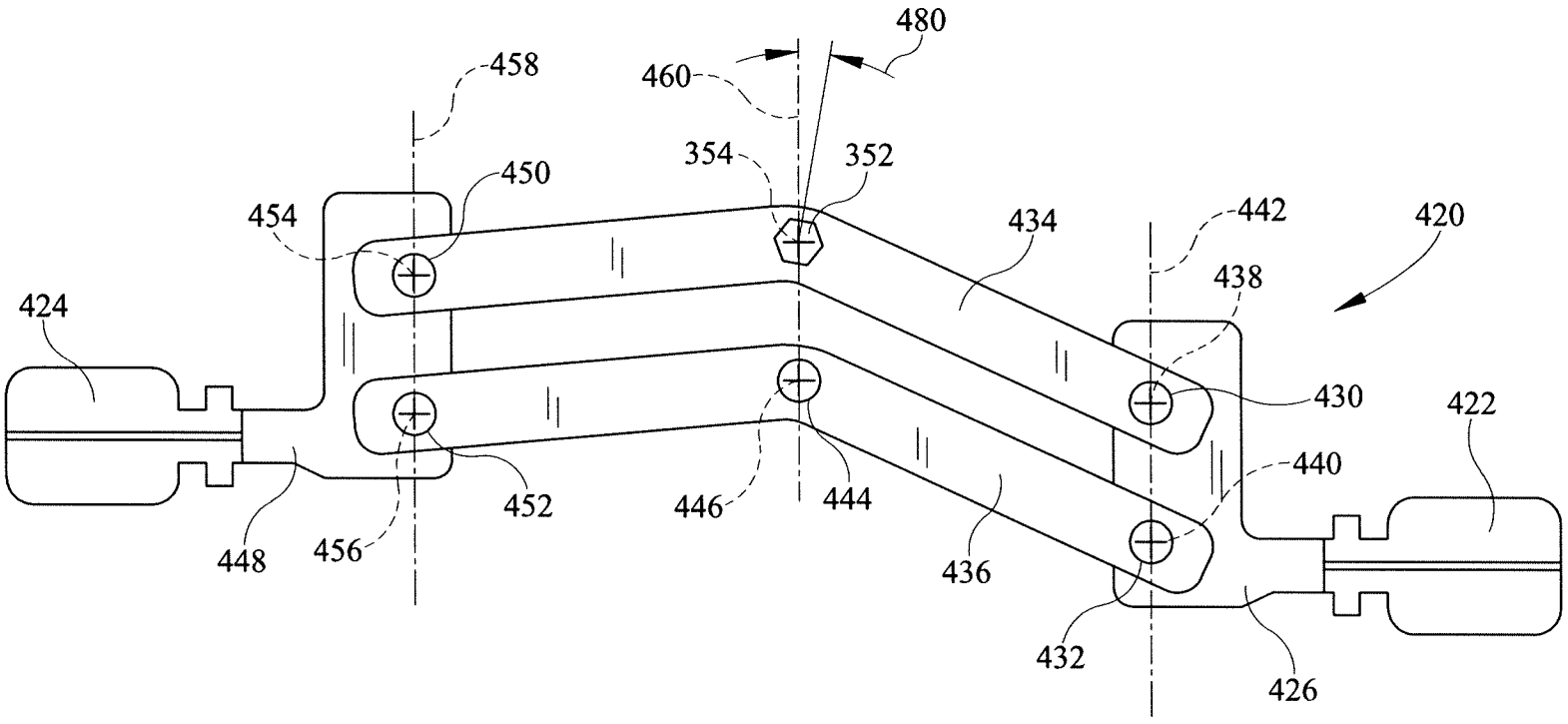
FIG. 27 is a diagrammatic view of the embodiment of FIG. 26 in a different position.

In yet another embodiment, the actuation mechanism 350 may include an input assembly 420 that is configured as a parallelogram linkage to maintain a first pedal 422 and a second pedal 424 in a level configuration throughout the rotation of the hex rod 352 as shown in FIGS. 26-28. The input assembly 420 includes a first actuator 426 that supports the pedal 422. When a user applies a force to the actuator 426 through the pedal 422, the force is transferred to two pins 430 and 432 on the actuator 426 that pivotably connect the actuator to two links 434 and 436 respectively. The pins 430 and 432 each define a respective rotation axis 438 and 440. The axes 438 and 440 lie on a vertical line 442.

The link 434 is supported on the hex rod 352 and pivots about the axis 354. The link 436 is pivotably supported on pin 444 that is fixed to the frame 300 with the link 436 pivotable about an axis 446 defined by the pin 444. A second actuator 448 supports the pedal 424 and is pivotably connected to the links 434 and 436 by respective pins 450 and 452. The pins 450 and 452 each define a respective pivot axis 454 and 456 which lies on a line 458. The axis 354 of the hex rod 352 and the axis 446 of the pin 444 also lie on a line 460. Each side of the input assembly 420 defines a four bar parallelogram linkage that is grounded on the hex rod 352 and pin 444 such that movement of either actuator 426 or actuator 448 vertically, causes the links 434 and 436 to pivot on the respective axes 354 and 446 through an angle 480 shown in FIG. 27. Because of the parallelogram linkage, the actuators 426 and 448 are maintained with the pedals 422 and 424 in a horizontal orientation with the lines 442 and 458 shifting toward the line 460 when a force is applied to a pedal 422 or 424 as indicated by arrows 482 and 484 in FIG. 26. This is in contrast to the potential for causing the pedal surfaces to be inclined as occurs with pure rotation about a fixed axis. Thus, a user is less likely to have their foot slide off of the pedals 422 and 424. The rotational motion that is imparted by force acting on either pedal 422 or 424 is transferred through the hex rod 352 to the remainder of the mode changing mechanism 302.

It should be understood that the actuation mechanisms disclosed herein may be positioned at multiple locations around the perimeter of the base 12 such that one or more actuation mechanisms may be used to actuate a caster mode mechanism between multiple positions to thereby position the respective casters in a specific mode by rotating the mode key, which is embodied as a hex rod. An actuation mechanism acts on a mode key by transferring a torque to the mode key to rotate the mode key and change the mode of a caster. In some embodiments, an actuation mechanism includes an actuator that, when acted on by a force, transfers the force to the mode key. The direction of rotation of the mode key may be reversed for a given input force by configuring the actuation mechanism to operate with a reverse torque.

It should be understood that the various actuation mechanisms 324, 326, 350, 360, and 380 as well as mirrored actuation assemblies may be applied at multiple locations about the base 12, to create various mode conditions. For example, the some pedals may move downwardly when a first pedal is pushed down while others may move up. In some embodiments, some pedals may move up and some may move down with a given motion. In other embodiments, all of the pedals may move in the same direction. A single actuator may be used to change the mode of all of the casters, or a portion of the caster mode mechanism may operate independently from the remainder of the caster mode mechanism.

Still further, a powered device may be used to apply a force to an actuator to change the caster mode within the scope of this disclosure.

Although the invention has been described with reference to the preferred embodiments, variations and modifications exist within the scope and spirit of the invention as described and defined in the following claims.

The invention claimed is:

1. A brake system for a patient support apparatus having a base comprises a plurality of casters supporting the base on surface of a floor the casters having a plurality of modes, a caster mode changing mechanism moveable between a plurality of positions, a plurality of pedals positioned to be moved by a user to move the caster mode mechanism between the plurality of positions, at least a first one of the plurality of pedals positioned adjacent a head end of the base, and wherein the caster mode changing mechanism coordinates movement of the plurality of pedals so that movement of any one of the plurality of pedals causes movement of the caster mode changing mechanism to thereby rotate a mode change key to change the mode of at least one caster, and wherein downward movement of the at least one pedal positioned adjacent the head end of the base causes the caster mode key to move from a first position to a second position, wherein at least two of the plurality of pedals are positioned adjacent the head end of the base, the at least two pedals having generally collinear fulcrum axes with one of the at least two pedals coupled to the mechanism at a position below the fulcrum axes and another of the at least two pedals coupled to the mechanism at a position above the fulcrum axes.

2. The brake system of claim 1, wherein the plurality of pedals includes a second one of the plurality of pedals positioned adjacent the head end of the base, wherein downward movement of the second one of the plurality of pedals causes the caster mode changing mechanism to move from the second position to the first position.

3. The brake system of claim 2, wherein downward movement of the second one of the plurality of pedals positioned adjacent the head end causes the first one of the plurality of pedals positioned adjacent the head end to move upwardly.

4. The brake system of claim 3, wherein the caster mode changing mechanism is supported for movement relative to a frame of the base of the patient support apparatus.

5. A brake system for a patient support apparatus having a base comprises a plurality of casters supporting the base on surface of a floor the casters having a plurality of modes, a caster mode changing mechanism moveable between a plurality of positions, a plurality of pedals positioned to be moved by a user to move the caster mode mechanism between the plurality of positions, at least a first one of the plurality of pedals positioned adjacent a head end of the base, and wherein the caster mode changing mechanism coordinates movement of the plurality of pedals so that movement of any one of the plurality of pedals causes movement of the caster mode changing mechanism to thereby rotate a mode change key to change the mode of at least one caster, and wherein downward movement of the at least one pedal positioned adjacent the head end of the base causes the caster mode key to move from a first position to a second position, wherein the patient support apparatus further includes an input assembly positioned on a lateral side of the patient support apparatus, the input assembly operable to move the caster mode changing mechanism.

6. The brake mechanism of claim 5, wherein the input assembly positioned on a lateral side of the patient support apparatus comprises a pair of pedals coupled to a parallelogram linkage, the pedals maintaining a horizontal orientation during movement of the pedals between a first position and a second position.

7. A brake system for a patient support apparatus having a base comprises a plurality of casters supporting the base on surface of a floor the casters having a plurality of modes, a caster mode changing mechanism moveable between a plurality of positions, a plurality of pedals positioned to be moved by a user to move the caster mode mechanism between the plurality of positions, at least a first one of the plurality of pedals positioned adjacent a head end of the base, and wherein the caster mode changing mechanism coordinates movement of the plurality of pedals so that movement of any one of the plurality of pedals causes movement of the caster mode changing mechanism to thereby rotate a mode change key to change the mode of at least one caster, and wherein downward movement of the at least one pedal positioned adjacent the head end of the base causes the caster mode key to move from a first position to a second position, wherein the plurality of pedals positioned adjacent the head end of the base each have a fulcrum axis that corresponds to a fulcrum of the pedal, the fulcrum axes of each of the plurality of pedals being generally collinear, wherein at least one of plurality of pedals positioned adjacent the head end of the base is coupled to the mechanism at a position below the fulcrum axes.

8. A patient support apparatus comprising, a lower frame including a plurality of casters, each caster including at least two operating modes, and a mode changing mechanism operable to simultaneously modify the mode of at least two casters, the mode changing mechanism including a first actuation mechanism having a first actuator, a first control arm pivotably coupled to the first actuator, a first follower pivotably coupled to the first control arm, the first follower engaged with a first mode key to transfer motion from the first actuator to the first mode key to rotate the first mode key about a first axis, the mode changing mechanism also including a first transfer arm pivotably coupled to the first actuator and positioned between the at least two casters, such that movement of the first actuator causes rotation of the first mode key and movement of the first transfer arm, wherein the follower extends generally vertically upwardly from the first mode key.

9. The patient support apparatus of claim 8, wherein the first actuator includes a force receiving area and the first actuator and the first transfer arm are pivotably coupled at a second axis.

10. The patient support apparatus of claim 8, wherein the follower extends generally vertically downwardly from the first mode key.

11. A patient support apparatus comprising, a lower frame including a plurality of casters, each caster including at least two operating modes, and a mode changing mechanism operable to simultaneously modify the mode of at least two casters, the mode changing mechanism including a first actuation mechanism having a first actuator, a first control arm pivotably coupled to the first actuator, a first follower pivotably coupled to the first control arm, the first follower engaged with a first mode key to transfer motion from the first actuator to the first mode key to rotate the first mode key about a first axis, the mode changing mechanism also including a first transfer arm pivotably coupled to the first actuator and positioned between the at least two casters, such that movement of the first actuator causes rotation of the first mode key and movement of the first transfer arm, wherein the first actuator includes a force receiving area and the first actuator and the first transfer arm are pivotably coupled at a second axis, wherein the first control arm is pivotably coupled to the first actuator at a third axis, the third axis positioned between the force receiving area and the second axis.

12. The patient support apparatus of claim 11, wherein the first control arm and the first follower are pivotably coupled at a fourth axis, the fourth axis offset from the first axis.

13. The patient support apparatus of claim 12, wherein the first mode key is engaged with a first caster such that at least a portion of the mode changing mechanism is supported from a first caster.

14. The patient support apparatus of claim 13, further comprising a second follower engaged with a second mode key, and wherein movement of the first transfer arm causes movement of the second mode key.

15. The patient support apparatus of claim 14, wherein the second mode key is engaged with a second caster such that the mode changing mechanism is dependently supported from the first and second casters.

16. The patient support apparatus of claim 11, wherein the fourth axis is positioned closer to the first axis than to the second axis.

17. The patient support apparatus of claim 11, wherein the fourth axis is positioned closer to the second axis than to the first axis.

18. The patient support apparatus of claim 11, wherein the distance between the first axis and the second axis varies when the first mode key is rotated.

19. The patient support apparatus of claim 18, wherein the distance between the third axis and fourth axis remains fixed when the first mode key is rotated.

20. The patient support apparatus of claim 19, wherein the distance between the first axis and the third axis remains fixed when the first mode key is rotated.

21. The patient support apparatus of claim 20, wherein a force applied to the force receiving area of the actuator causes rotation of the first mode key.

22. The patient support apparatus of claim 8, A patient support apparatus comprising, a lower frame including a plurality of casters, each caster including at least two operating modes, and a mode changing mechanism operable to simultaneously modify the mode of at least two casters, the mode changing mechanism including a first actuation mechanism having a first actuator, a first control arm pivotably coupled to the first actuator, a first follower pivotably coupled to the first control arm, the first follower engaged with a first mode key to transfer motion from the first actuator to the first mode key to rotate the first mode key about a first axis, the mode changing mechanism also including a first transfer arm pivotably coupled to the first actuator and positioned between the at least two casters, such that movement of the first actuator causes rotation of the first mode key and movement of the first transfer arm, wherein the mode changing mechanism further comprises a second actuation mechanism, the second actuation mechanism having a second actuator, a second control arm pivotably coupled to the second actuator, a second follower pivotably coupled to the second control arm, the second follower engaged with a second mode key to transfer motion from the second actuator to the second mode key to rotate the second mode key about a second axis.

23. The patient support apparatus of claim 22, wherein the second actuator is pivotably coupled to the first transfer arm.

24. The patient support apparatus of claim 23, wherein the pivotable coupling of the second control arm and the second follower is vertically higher than the second axis and the pivotable coupling of the first control arm and the first follower is vertically higher than the first axis.

25. The patient support apparatus of claim 24, wherein the first actuator and the second actuator move in the same vertical direction when the mode changing mechanism is moved between positions.

26. The patient support apparatus of claim 22, wherein the pivotable coupling of the second control arm and the second follower is vertically lower than the second axis and the pivotable coupling of the first control arm and the first follower is vertically higher than the first axis.

27. The patient support apparatus of claim 26, wherein the first actuator and the second actuator move in opposite vertical directions when the mode changing mechanism is moved between positions.

28. The patient support apparatus of claim 22, wherein the first follower and the second follower are connected by a transfer bar so that rotation of the first follower is transferred to the second follower.

29. The patient support apparatus of claim 28, wherein the second actuator is pivotably coupled to a second transfer arm so that movement of either the first or second actuators is transferred to both the first and second mode change keys and to both the first and second transfer arms.

30. The patient support apparatus of claim 8, wherein the mode changing mechanism further includes a second actuation mechanism having a second follower, the second follower pivotably about a second axis and pivotably coupled to the first transfer arm at a third axis such that rotation of the follower about the second axis causes movement of the first transfer arm.

31. The patient support apparatus of claim 30, wherein the second follower is coupled to a second mode key, the second mode key pivotable about the second axis.

32. The patient support apparatus of claim 31, wherein the second mode key is engaged with one of the plurality of casters to change the mode of the caster with which the second mode key is engaged.

33. A patient support apparatus comprising, a lower frame including a plurality of casters, each caster including at least two operating modes, and a mode changing mechanism operable to simultaneously modify the mode of at least two casters, the mode changing mechanism including a first actuation mechanism having a first actuator, a first control arm pivotably coupled to the first actuator, a first follower pivotably coupled to the first control arm, the first follower engaged with a first mode key to transfer motion from the first actuator to the first mode key to rotate the first mode key about a first axis, the mode changing mechanism also including a first transfer arm pivotably coupled to the first actuator and positioned between the at least two casters, such that movement of the first actuator causes rotation of the first mode key and movement of the first transfer arm, wherein the mode changing mechanism further includes a second actuation mechanism having a second follower, the second follower pivotably about a second axis and pivotably coupled to the first transfer arm at a third axis such that rotation of the follower about the second axis causes movement of the first transfer arm, wherein the second follower is coupled to a second mode key, the second mode key pivotable about the second axis, wherein the second mode key is engaged with one of the plurality of casters to change the mode of the caster with which the second mode key is engaged, wherein the second mode key is coupled to an input assembly, the input assembly including a second actuator operable to rotate the second mode key.

34. The patient support apparatus of claim 33, wherein the input assembly comprises a pair of pedals coupled to a parallelogram linkage, the pedals maintaining a horizontal orientation during movement of the pedals between a first position and a second position.

* * * * *